US006055401A

United States Patent [19]

Tonomoto et al.

[11] Patent Number: 6,055,401

[45] **Date of Patent: *Apr. 25, 2000**

[54] ELECTROPHOTOGRAPHIC IMAGE-FORMING APPARATUS HAVING DEVELOPING DEVICE WHICH INCLUDES A PLURALITY OF DEVELOPING ROLLERS

[75] Inventors: Yoshihiro Tonomoto; Hiroshi Sato; Toshio Hino; Toshimasa Toyama; Masaaki Ohyama; Osamu Watanabe, all of Kawasaki; Tsutomu Nagatomi, Hyogo; Yuzuru Sugiura, Hyogo; Hiroaki Naito, Hyogo; Jun Shimizu, Hyogo, all of Japan

[73] Assignee: Fujitsu Limited, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/712,547

[22] Filed: Sep. 11, 1996

[30] Foreign Application Priority Data

| | | | |
|---|---|---|---|
| Sep. 12, 1995 | [JP] | Japan | 7-233646 |
| Sep. 12, 1995 | [JP] | Japan | 7-234401 |
| Sep. 12, 1995 | [JP] | Japan | 7-234402 |
| Oct. 25, 1995 | [JP] | Japan | 7-277470 |
| Nov. 20, 1995 | [JP] | Japan | 7-300975 |

[51] Int. Cl.[7] ..... G03G 15/09

[52] U.S. Cl. ..... 399/269; 399/272

[58] Field of Search ..... 399/269, 272, 399/279, 281, 258

[56] References Cited

U.S. PATENT DOCUMENTS

| | | | |
|---|---|---|---|
| 3,999,514 | 12/1976 | Abbott et al. . | |
| 4,131,357 | 12/1978 | Forbes . | |
| 4,173,405 | 11/1979 | Swapceinski et al. | 399/256 |
| 4,177,757 | 12/1979 | Murakawa et al. | 399/269 |
| 4,235,193 | 11/1980 | Groen et al. | 399/269 |
| 4,324,483 | 4/1982 | Tagawa et al. | 399/272 |
| 4,436,055 | 3/1984 | Yamashita et al. | 399/269 |
| 4,442,790 | 4/1984 | Swapceinski et al. | 399/269 |
| 4,937,625 | 6/1990 | Kato et al. | 399/258 |
| 4,996,565 | 2/1991 | Herley | 399/256 |
| 5,097,295 | 3/1992 | Tanaka . | |
| 5,310,423 | 5/1994 | Aimoto et al. . | |

FOREIGN PATENT DOCUMENTS

| | | |
|---|---|---|
| 56-33667 | 4/1981 | Japan . |
| 61-22365 | 1/1986 | Japan . |
| 2-226279 | 9/1990 | Japan . |
| 5-265329 | 10/1993 | Japan . |
| 5-341645 | 12/1993 | Japan . |
| 6-75466 | 3/1994 | Japan . |

*Primary Examiner*—Robert Beatty
*Attorney, Agent, or Firm*—Armstrong, Westerman, Hattori, McLeland & Naughton

[57] ABSTRACT

A developing apparatus of an electrophotographic apparatus includes a housing for accommodating a developer, first, second and third developing rollers are rotatably disposed in the housing and arranged opposite to a photoconductor drum for conveying a developer carried on respective surfaces of the developing rollers, and a conveyor roller rotatably disposed in the housing for conveying the developer carried on a surface thereof to one of the developing rollers. First and second screw conveyors are disposed in the housing for conveying the developer in an axial direction opposite to each other. Each of these conveyors has an axial length larger than an axial length of the developing rollers. A partition wall is disposed between the first and second screw conveyors. A toner container for accommodating a toner is mounted on the housing. The toner in the toner container is supplied into the housing and agitators agitate the toner in the housing. A first doctor blade regulates the developer carried on the conveyor roller, a second doctor blade regulates the developer on the first developing roller, and scrapers scrape the developer from the second and third developing rollers.

4 Claims, 25 Drawing Sheets

ELECTROPHOTOGRAPHIC IMAGE-FORMING APPARATUS HAVING DEVELOPING DEVICE WHICH INCLUDES A PLURALITY OF DEVELOPING ROLLERS

BACKGROUND OF THE INVENTION

1. Field of the Invention

The present invention relates to electrophotographic image-forming apparatuses, such as laser beam printers or LED printers.

Due to the recent development in office automation, electrophotographic image-forming apparatuses, such as laser beam printers, have been widely used in computer output terminals, copying machines, facsimile machines or others.

In such image-forming apparatuses, a hard copy is obtained by the steps of charging a photoconductor drum at a predetermined potential by a charger, forming an electrostatic latent image corresponding to an image information on the photoconductor drum by irradiating a light beam thereto, developing the latent image with a toner, transferring the developed image to a recording medium, and fixing the same to the recording medium.

After the transfer step, the photoconductor drum is decharged by a discharger, and the residual toner is scraped off from the surface of the photoconductor drum by a cleaner, thus one cycle of the printing operation is completed on the photoconductor drum.

2. Description of the Related Art

As methods for developing the electrostatic latent image on the photoconductor drum, there are two methods, i.e., two-component developing method using a developer containing carrier and toner and one-component developing method using a developer containing only toner.

One-component developing method is generally simple in construction of the developing apparatus and, therefore, has been widely used for small-sized printers in the recent years. However, for high speed printers, the two-component developing method using a developer containing carrier and toner is still mainly applied.

In a developing apparatus for high speed printers, some problems will occur which might not occur in low or medium speed printers. For example, since a photoconductor drum which holds an electrostatic latent image is rotated in a high speed, the circumferential speed of a developing roller which holds the developer must be increased so as to supply a sufficient amount of developer to the electrostatic latent image so as to properly develop the same.

To attain such a developing apparatus, the developing roller should be rotated in a high speed or the size of the developing magnet roller should be increased to increase the circumferential speed of the developing roller. However, with a single developing roller, it is difficult to supply a sufficient amount of developer to the electrostatic latent image on the photoconductor drum.

As another problem in high speed printers, it is difficult to uniformly supply the developer along the whole axial length of the photoconductor drum to uniformly develop the electrostatic latent image. In particular, it is relatively difficult to supply sufficient toner to the respective end portions of the photoconductor drum.

In an electrophotographic printer, such as LED printers employing magnetic brush developing method, a bias voltage is applied to the developing roller and the developer housing itself is generally charged at the same potential as the bias voltage and, therefore, a toner hopper attached to the developer housing is also in general charged at the same level. Therefore, the toner cartridge cannot be used to supply the toner into the toner hopper during the printing operation.

SUMMARY OF THE INVENTION

Accordingly, an object of the present invention is to provide an electrophotographic image-forming apparatus having a developing apparatus in which the above-mentioned drawbacks can be overcome.

Another object of the present invention is to provide an electrophotographic image-forming apparatus having an improved toner reuse efficiency.

A further object of the present invention is to provide an electrophotographic image-forming apparatus capable of preventing the deterioration of qualities of the printed image, such as shade irregularity or fog, and being easily assembled and maintained.

According to the present invention, there is provided a developing apparatus of an electrophotographic apparatus comprising: a housing for accommodating a developer; a plurality of developing rollers rotatably disposed in the housing and arranged opposite to an electrostatic latent image carrying body for conveying a developer carried on respective surfaces of the developing rollers; a conveyor roller rotatably disposed in the housing for conveying the developer carried on a surface thereof to one of the developing rollers; a first screw conveyor disposed in the housing for conveying the developer in an axial direction thereof to supply it to the conveyor roller; a second screw conveyor disposed in the housing for conveying the developer in an axial direction opposite to the axial direction of the first screw conveyor to supply it to the first screw conveyor; each of the first and second conveyors having an axial length larger than an axial length of the developing rollers; a partition wall disposed between the first and second screw conveyors; a toner container for accommodating a toner, the container is mounted on the housing; a toner supply means for supplying the toner in the toner container into the housing; and an agitating means for agitating the toner supplied by the toner supply means and the developer in the housing.

According to another aspect of the present invention, there is provided an electrophotographic apparatus comprising: an electrostatic latent image carrying body disposed in the apparatus, the image carrying body having an outer surface electrified at a predetermined potential; a first corona electrifying unit disposed opposite to the image carrying body and a second corona electrifying unit disposed at a downstream position of the first corona electrifying unit and opposite to the image carrying body; each of the first and second corona electrifying units comprising: a box-shaped conductive chassis having an opening surface; a plurality of corona discharging wires attached to the chassis by means of electrically insulating means so as to extend thereover; grid wires attached to the chassis so as to extend along the opening surface; and a back electrode bar attached to the chassis so as to be spaced by a predetermined distance from a particular corona discharging wire among the plurality of corona discharging wires.

According to still another aspect of the present invention, there is provided a developing apparatus of an electrophotographic apparatus comprising: a housing for accommodating a developer, the housing having a developer outlet port at a bottom thereof; a screw means for conveying the developer to the developer outlet port; means for driving the screw means; means for guiding the developer from the developer outlet port to a developer collecting container; and a control means for controlling the screw driving means in such a manner that screw driving means is actuated intermittently or a driving speed thereof is reduced for a predetermined time period from a start of the developing apparatus.

According to further aspect of the present invention, there is provided an electrophotographic apparatus comprising: an electrostatic latent image carrying body; a housing for accommodating a developer including at least a magnetic material; a developing roller rotatably disposed in the housing and arranged opposite to the electrostatic latent image carrying body for conveying a developer to an outer surface of the latent image carrying body; a doctor blade arranged opposite to the developing roller at a position upstream with respect to a rotating direction thereof from a developing area defined between the latent image carrying body and the developing roller, the doctor blade regulates a height of "ears or spikes" the developer attached onto the developing roller; and a magnetic means for changing a magnetic field in the vicinity of the doctor blade.

According to still further aspect of the present invention, there is provided an electrophotographic apparatus comprising: an electrostatic latent image carrying body; a housing for accommodating a developer including at least a magnetic material; a developing magnet roller disposed in the housing and arranged opposite to the electrostatic latent image carrying body to form a developing area therebetween; a developer head regulating means arranged opposite to the developing roller at a position upstream with respect to a rotating direction thereof from the developing area, the developer head regulating means regulates a height of head of the developer attached onto the developing roller; and a developer holding magnet roller rotatably arranged opposite to the developing roller at a position slightly upstream of the developer head regulating means.

BRIEF DESCRIPTION OF THE DRAWINGS

The present invention will be described in more detail with reference to the attached drawings illustrating the preferred embodiments; wherein.

DETAILED DESCRIPTION OF THE EMBODIMENTS

Figure 1:
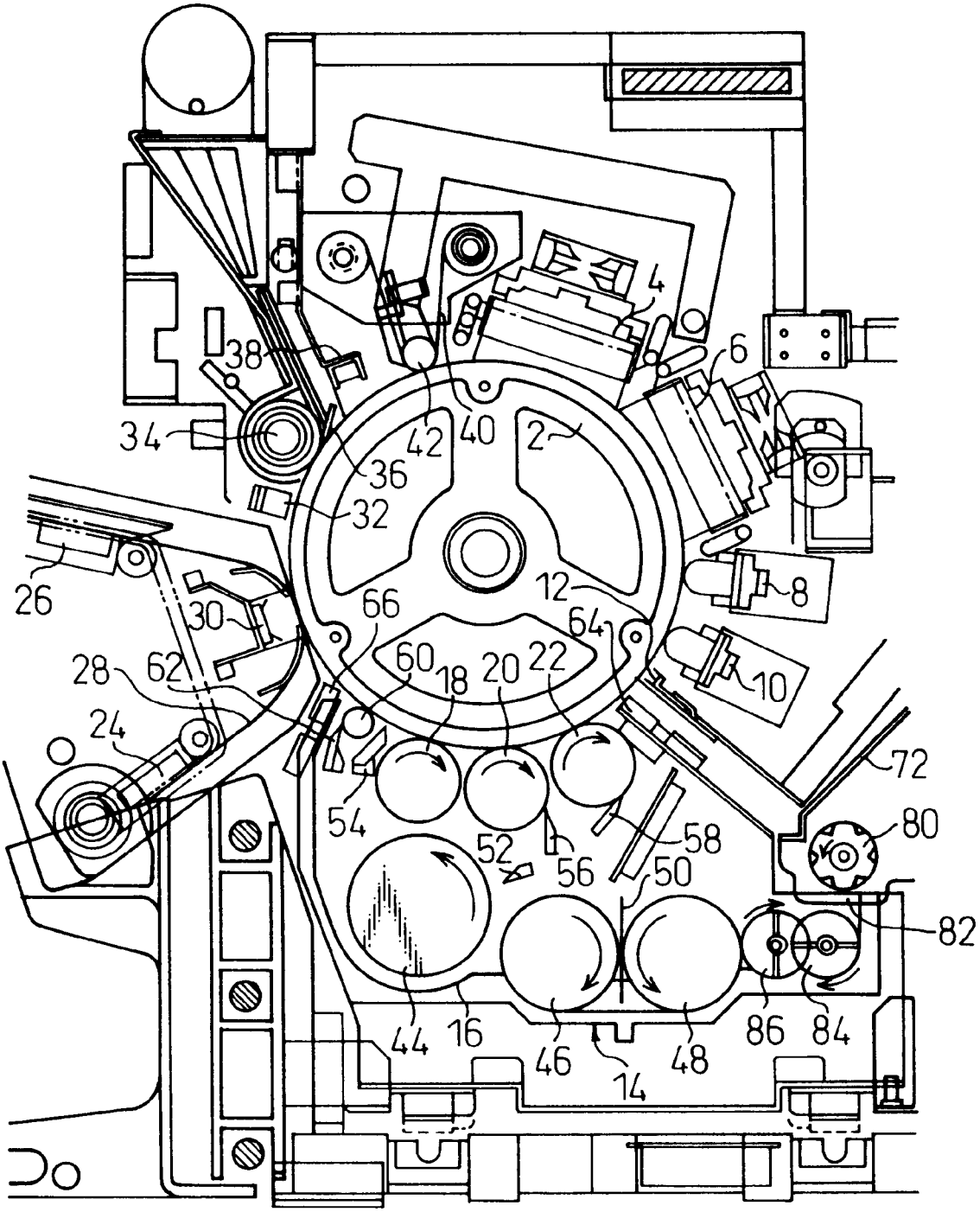
FIG. 1 is an illustration of an overall structure of a printer employing a developing apparatus according to the present invention.

FIG. 1 illustrates a LED printer including a developing apparatus according to the present invention. A photoconductor drum 2 is usually made of a photoconductor or photosensitive material, such as, an amorphous silicon and is rotated in the clockwise direction at a high speed.

The surface of the photoconductor drum 2 is electrically charged to +400V by a first corona charger 4 and a second corona charger 6. To uniformly charge the surface of photoconductor drum 2, scorotron corona chargers having grid electrodes are used as the first and second corona chargers 4 and 6. The embodiment illustrated in FIG. 1 is a high speed LED printer and, therefore, two corona chargers 4 and 6 are used.

There are a 240 dpi (dot per inch) LED head 8 and a 400 dpi LED head 10 which are selectively actuated in accordance with a necessary resolution, so that an electrostatic latent image is formed on the photoconductor drum 2 in response to an image information.

A surface potential sensor 12 detects the voltage on the surface of the photoconductor drum 2 when an electric power of this printer is turned on or when a waiting mode is released. Thus, the first and second corona chargers 4 and 6 are feedback-controlled so that the voltage on the surface of the photoconductor drum 2 is at a predetermined value.

Then, the electrostatic latent image on the photoconductor drum 2 is developed by a developing apparatus 14. This developing apparatus 14 is a magnetic brush developing apparatus which has a housing 16 provided with three developing magnet rollers 18, 20 and 22 rotatably mounted therein.

A two-component developer composing of toner and carrier is accommodated in the housing 16. The electrostatic latent image on the photoconductor drum 2 is developed by the electromagnetic brush formed by the magnet rollers 18, 20 and 22 and, therefore, a toner image is formed on the photoconductor drum 2. The developing apparatus 14 will be described hereinafter in more detail.

Upper and lower tractors 24 and 26 feed a continuous sheet of paper 28. The toner image on the photoconductor drum 2 is transferred onto the continuous sheet of paper 28 by a corona discharge of opposite polarity to the toner from the back surface of the continuous sheet of paper 28. The toner image transferred onto the continuous sheet of paper 28 is permanently fixed by a flash fixing unit (not shown).

On the other hand, the electric charge of the residual toner on the photoconductor drum 2 is reduced by an AC corona discharger 32 and the toner removed from the photoconductor drum 2 by a cleaning brush 34 and a cleaning blade 36. The potential of the surface of the photoconductor drum 2 is then reduced by the decharging LED 38.

Upon operating this printer for a long time, the surface of the photoconductor drum 2 is gradually covered with a film, which is to be removed in this embodiment by pushing a web 40, by a roller 42 made of silicon carbide, against the surface of the photoconductor drum 2.

The developing apparatus 14 will now be described in detail. Each of the above-mentioned magnet rolls 18, 20 and 22 comprises a stationary magnet and a sleeve made of non-magnetic body, such as aluminum, which is rotated around the stationary magnet. The sleeves of these magnet rolls 18, 20 and 22 are rotated in the clockwise direction as indicated by arrows.

A conveyor roll 44 is arranged under the magnet roll 18. The conveyor roll 44 has the same structure as the magnet rolls and comprises a stationary magnet and a sleeve which is rotated therearound. The conveyor roll 44 is rotated in the counter-clockwise direction to supply the developer to the magnet roll 18.

The screw conveyors 46 and 48 feed the developer in their axial directions and rotate in opposite directions to each other. In the illustrated embodiment, the screw conveyor 46 is rotated in the clockwise direction and the screw conveyor 48 is rotated in the counter-clockwise direction.

Figure 6:
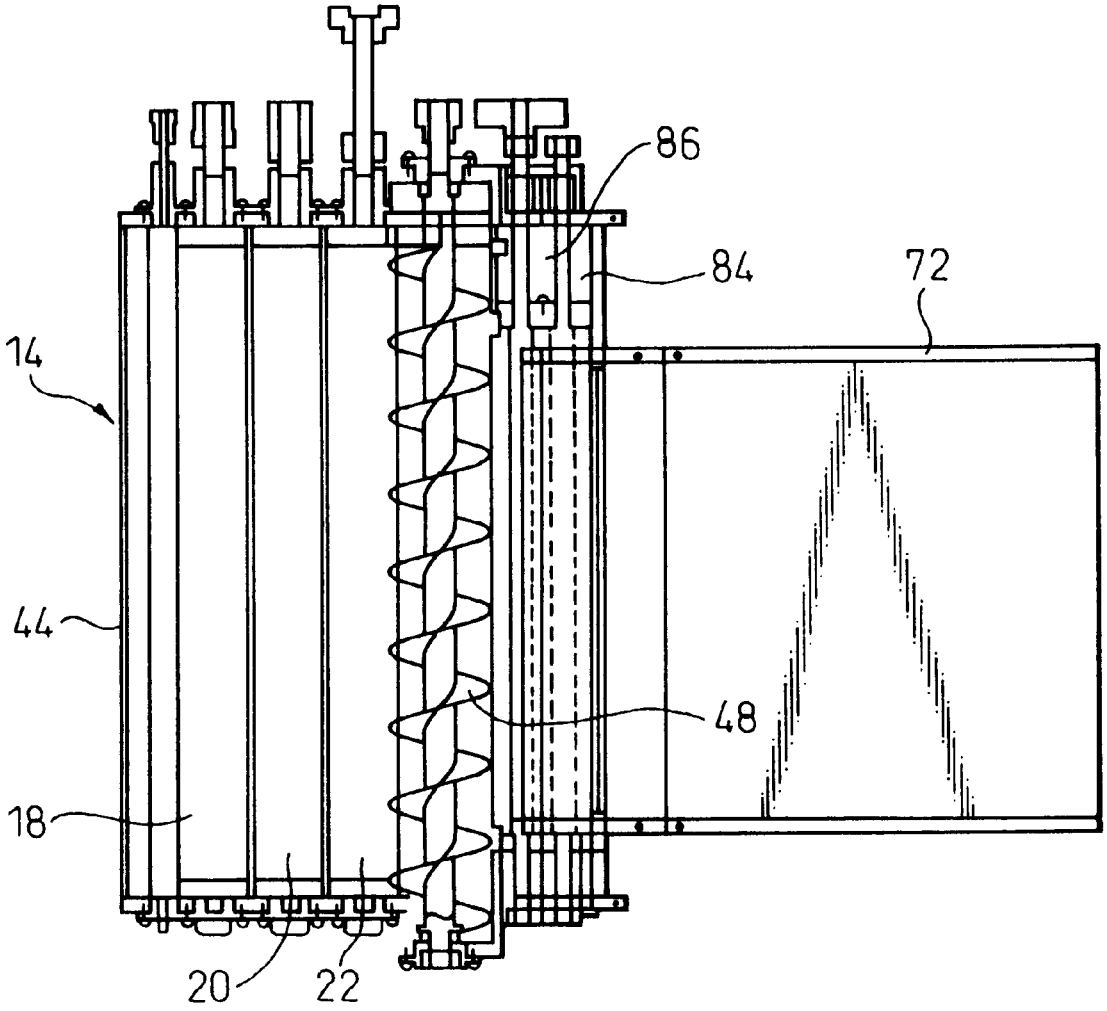
FIG. 6 is a plan view of the developing apparatus in which a detailed illustration of toner hopper is omitted.

A partition wall 50 is arranged between the screw conveyors 46 and 48. As clearly shown in FIG. 6, the screw conveyors 46 and 48 (the screw conveyor 46 is omitted in FIG. 6) are longer in the axial direction than the magnet rolls 18, 20 and 22.

Since the screw conveyors 46 and 48 have a long axial length, the screw conveyors 46 and 48 feed the developer uniformly and entirely over full length of the conveyor roll 44. Thus, it will be possible to feed the developer over the full length of each of the magnet rolls 18, 20 and 22 and the electrostatic latent image on the photoconductor drum 2 rotating in a high speed can be developed uniformed over the full width (or axial length) of the photoconductor drum 2.

A doctor blade 52 regulates the thickness of the developer on the conveyor roll 44 and a doctor blade 54 regulates the thickness of the developer on the magnet roll 18. In this embodiment, since the two doctor blades 52 and 54 are used to regulate the thickness of the developer attached to the magnet rolls 18, 20 and 22, a large load is prevented from being exerted to the doctor blade 54 located against the magnet roll 18.

Figure 3:
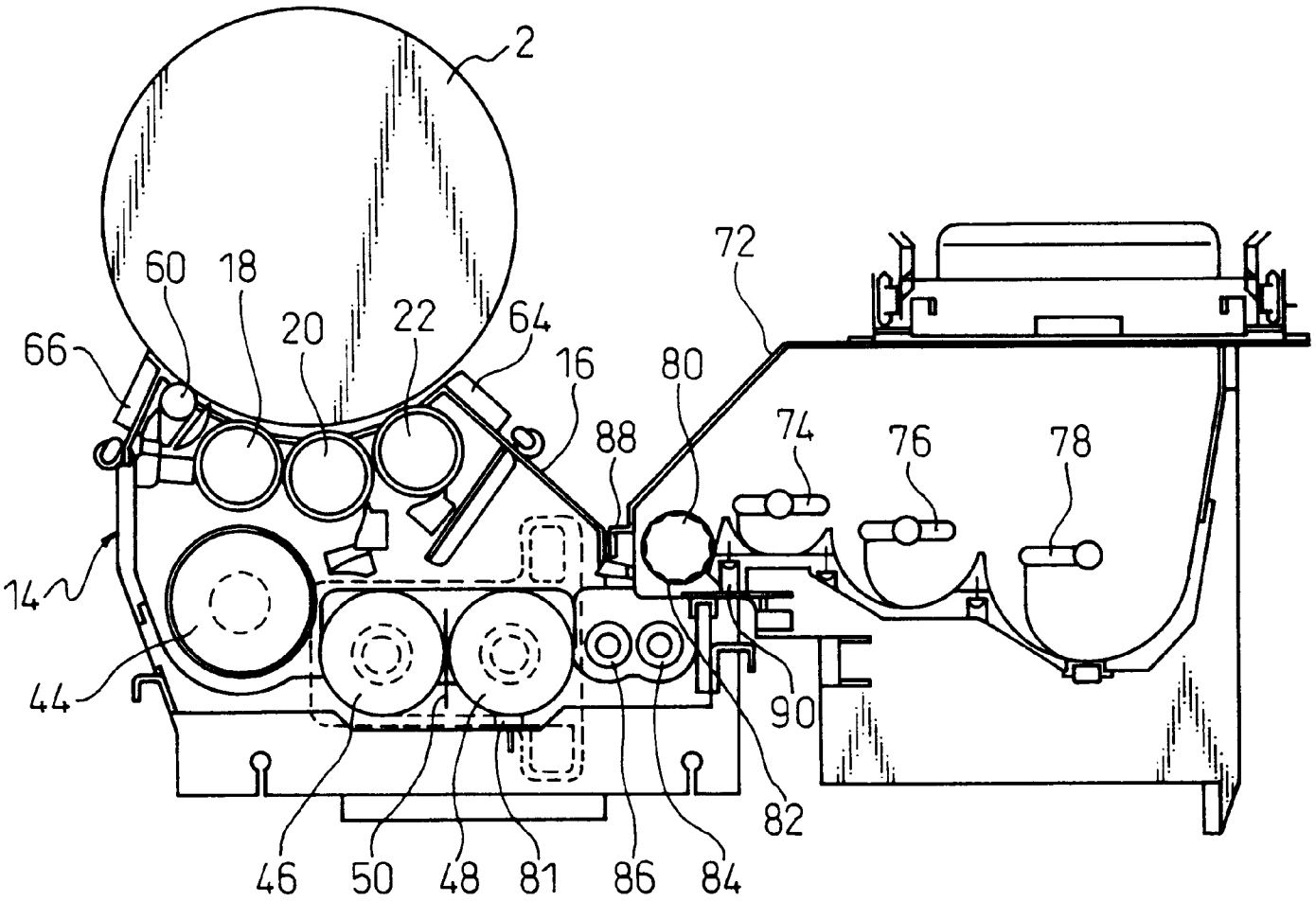
FIG. 3 is a cross-sectional view of the developing apparatus.

Magnetic brushes are formed on the magnet rolls 18, 20 and 22, as shown in FIG. 3, and these magnetic brushes touch the electrostatic latent image on the photoconductor drum 2, so that the electrostatic latent image becomes thus a visible toner image.

The developer on the magnet roll 20 is scraped off by the scraper 56 and the developer on the magnet roll 22 is scraped off by the scraper 58. The carrier on the photoconductor drum 2 is collected by a recovery magnet roll 60, scraped off by a scraper 62 from the magnet roll 60 and dropped into the housing 16.

Figure 2:
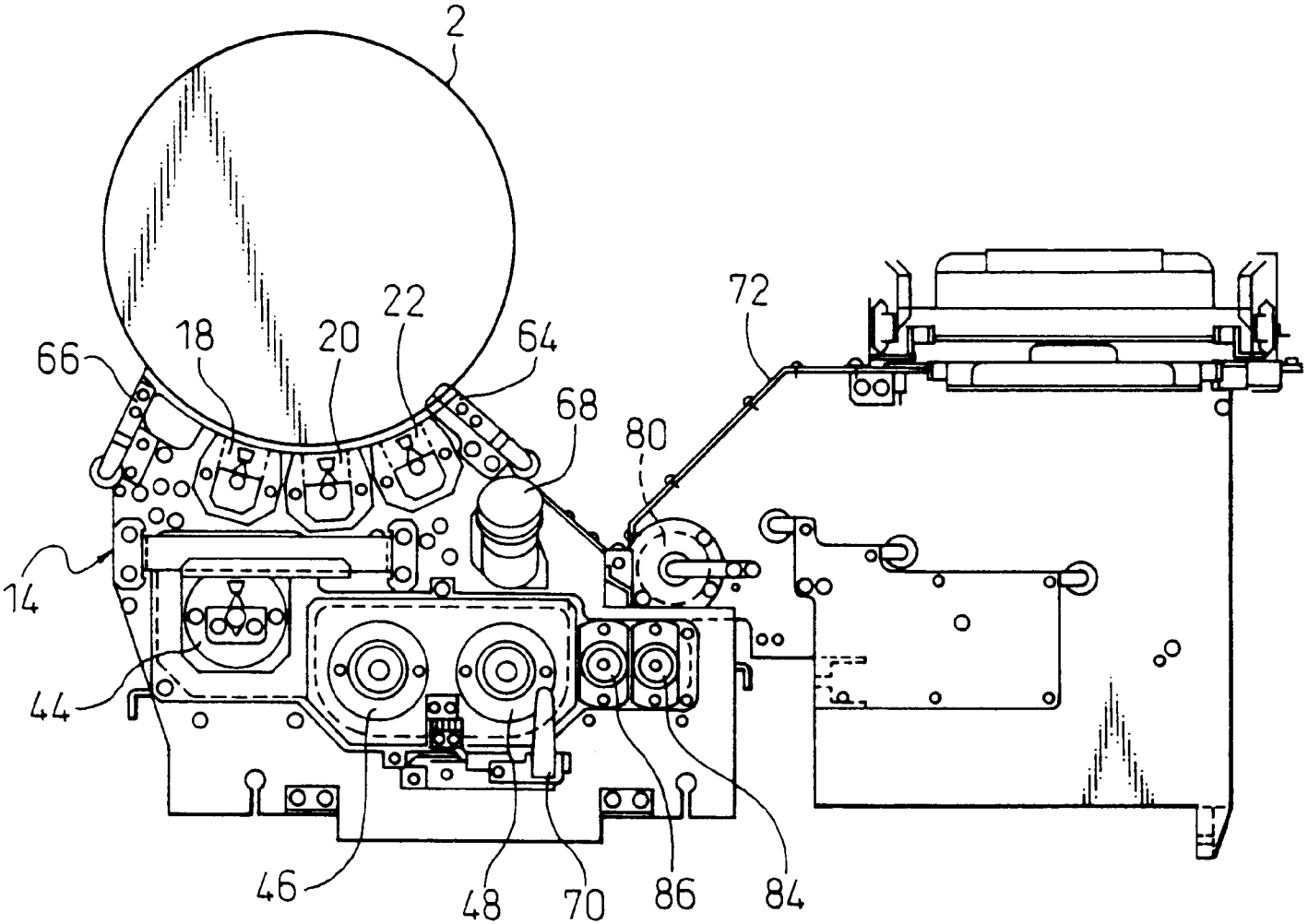
FIG. 2 is a side elevational view of the developing apparatus.

Recovery ducts 64 and 66 collect the toner scattered from the developing apparatus 14 by a vacuum suction through the ducts. In FIG. 2, there are a developer inlet port 68 and a lever 70 for opening and closing a developer outlet port. The developer in the housing becomes deteriorated when a certain period of time has passed.

The deterioration of the developer is indicated, such as on a display, so that the operator can operate the developer outlet port opening/closing lever 70 to discharge the developer and introduce fresh developer into the housing 16 through the developer inlet port 68.

As shown particularly in FIGS. 2 and 3, a toner hopper 72 is attached to the housing 16 by means of insulating members 88 and 90, so that the toner hopper 72 is electrically insulated from the housing 16.

In the toner hopper 72 there are three agitators 74, 76 and 78 which are rotatably mounted in the clockwise direction in FIG. 3, so that the toner in the toner hopper 72 is agitated and fed toward the toner supply roller 80.

The density of toner is detected by a toner density sensor 81 arranged under the screw conveyor 48. In accordance with the detected toner density, the toner supply roller 80 is rotated to supplement the toner in the toner hopper 72 through opening 82 into the housing 16 of the developing apparatus 14.

The supplemented toner is agitated, by the agitating paddles 84 and 86 rotating in the clockwise direction, and is mixed with the developer in the housing 16.

Figure 4:
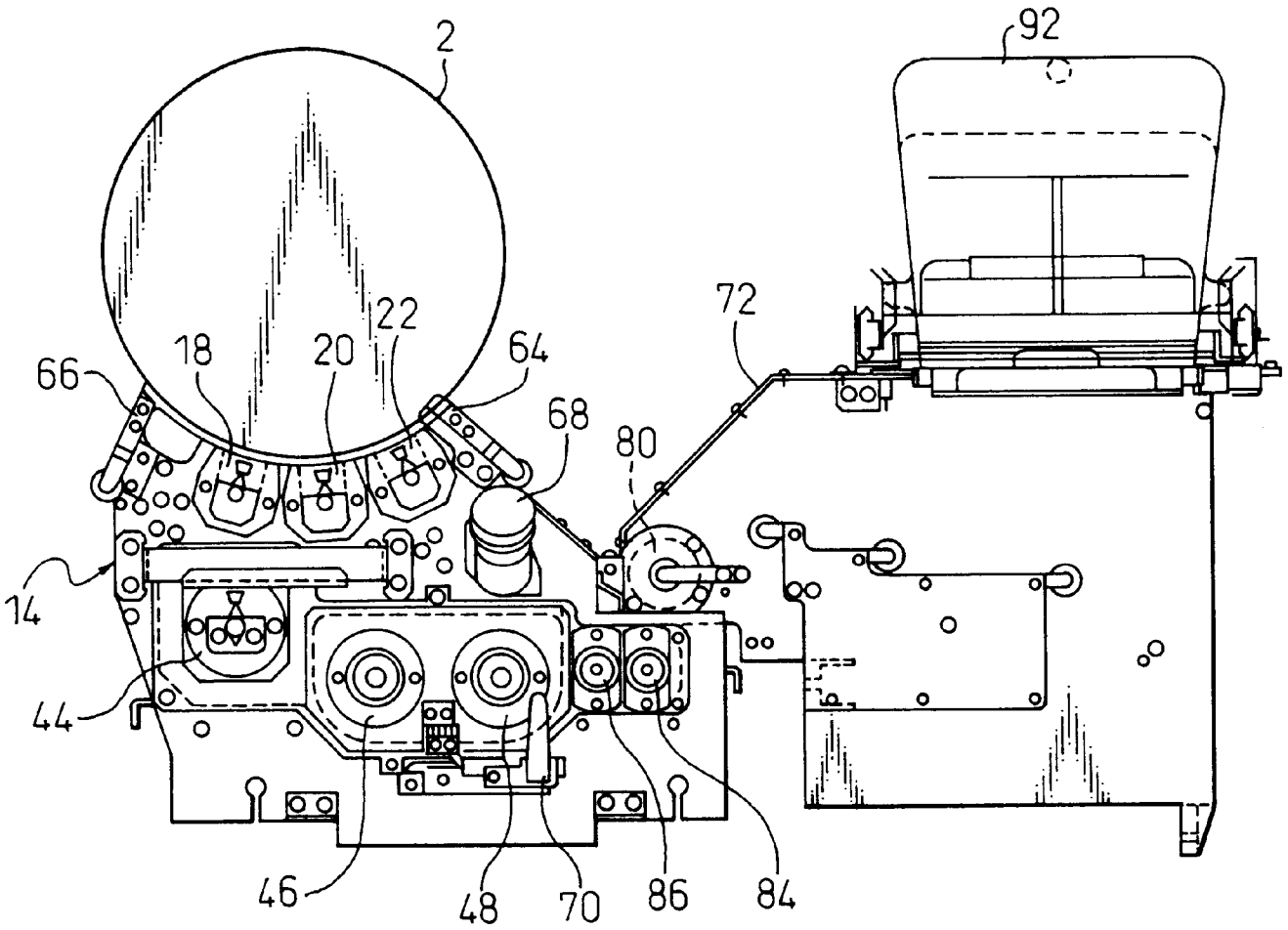
FIG. 4 is a side elevational view of the developing apparatus on which a toner cartridge is mounted.
Figure 5:
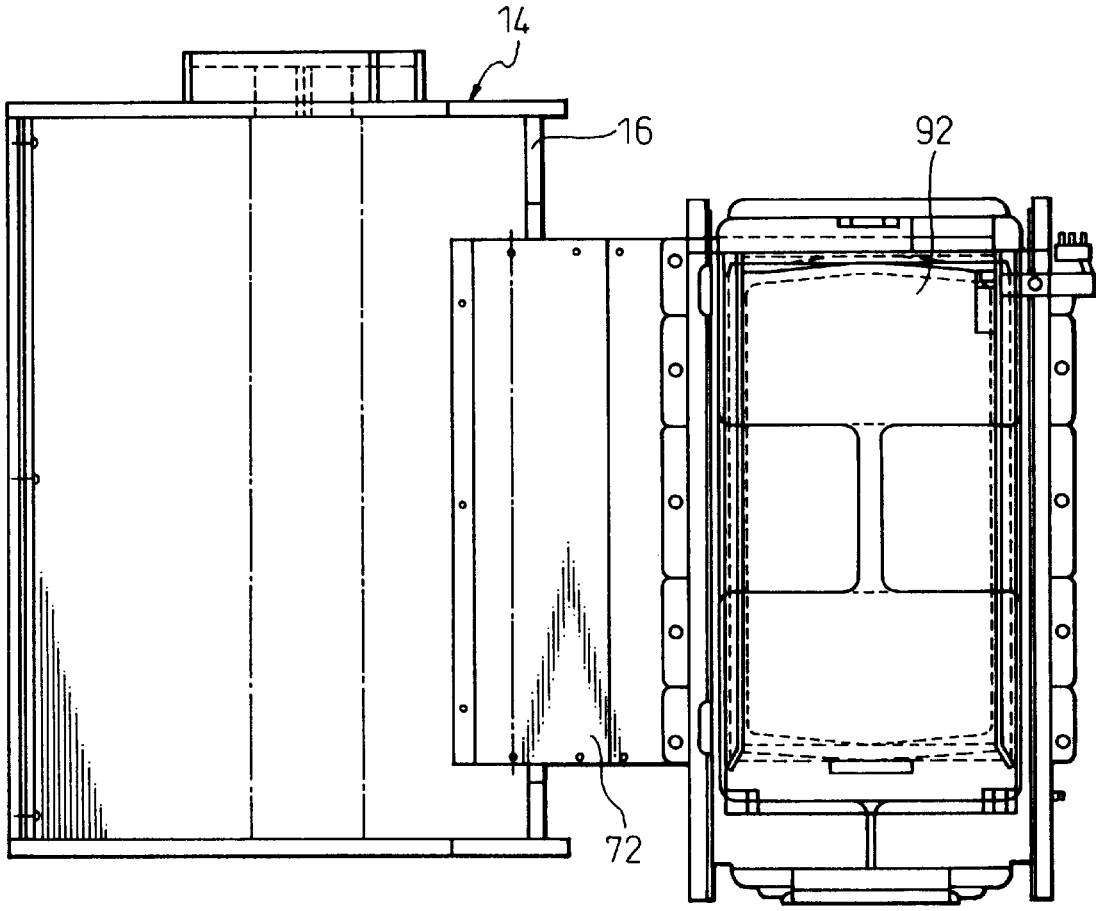
FIG. 5 is a plan view of the developing apparatus in which some parts in the housing are omitted.

FIGS. 4 and 5 are side elevational and plan views of the toner hopper equipped with a toner cartridge 92. When the toner in the toner hopper 72 is exhausted, the toner cartridge 92 is mounted on the toner hopper 72 to supplement the toner in the toner hopper 72.

Since the toner hopper 72 is attached to the housing 16 of the developing apparatus 14 by means of the insulating members 88 and 90, as mentioned above, the toner hopper 72 is thus electrically isolated from the housing 16. Therefore, although a bias voltage is applied to the housing 16, the potential of the toner hopper 72 is held at the frame ground level and, therefore, a toner supplemental operation by the toner cartridge 92 can be effected even during a printing operation.

Figure 7:
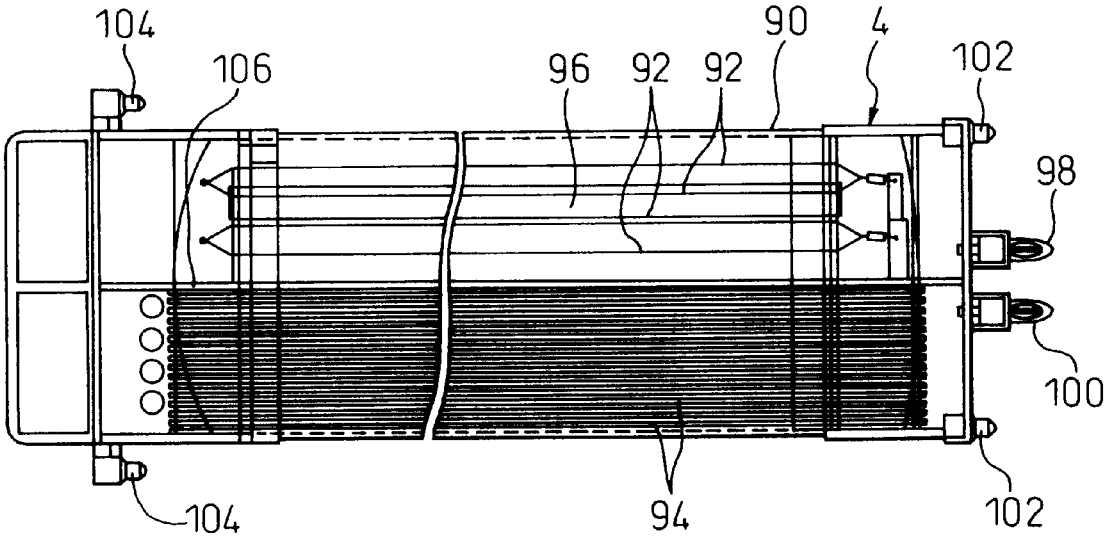
FIG. 7 is a plan view of a scorotron charger.
Figure 8:
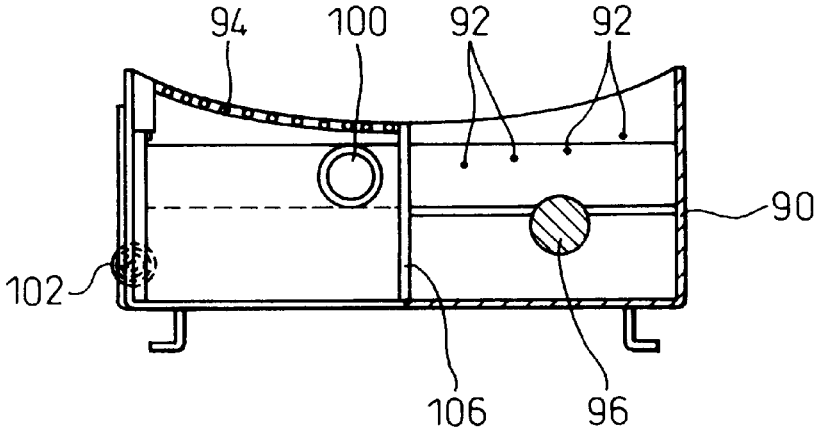
FIG. 8 is a plan view, partially illustrated in a cross-section, of the scorotron charger.

Referring now to FIGS. 7 and 8, a structure of the corona chargers 4 and 6 are described in detail. Since the both corona chargers 4 and 6 have the same structure, an explanation for the corona charger 4 will also be applied to the corona charger 6.

A box-shaped chassis (shield) 90 is made of a conductive material, such as, stainless steel, and has an opening surface. The chassis 90 is provided with eight corona discharge wires 92 extending over and electrically isolated from the body of the chassis 90. The corona discharge wires 92 are made of tungsten to which a high voltage of approximately 7 KV is applied by means of terminals 98.

Grid wires 94 made of tungsten are extended over the opening surface of the chassis 90, so that opened ratio of the opening surface of the chassis 90 is about 90%. The chassis 94 and the grid wires 94 are connected to a bias power source of approximately 700V. As shown particularly in FIG. 8, the chassis 94 is divided into two portions by a longitudinal central partition wall 106. A back electrode bar 96 is arranged in each of the divided two portions of the chassis 94.

As the back electrode bars 96 and the central partition wall 106 are provided as mentioned above, the respective corona discharge wires 92 are arranged at an approximately constant distance from the chassis 90, the back electrode bars 96 and the central partition wall 106. Thus, the discharge characteristic from the respective discharge wires can be uniform.

As shown in FIG. 7, the corona charger 4 is provided at one end thereof with a pair of positioning pins 102 and in the vicinity of the other end thereof with a pair of positioning pins 104. Thus, the corona charger 4 can be attached onto the painter at a predetermined position by inserting these positioning pins 102 and 104 into positioning holes of the printer body.

In this embodiment, two corona chargers 4 and 5 are arranged opposite to the photoconductor drum 2, as shown in FIG. 1. The discharge conditions of these corona chargers 4 and 5 can be feedback-controlled in accordance with the surface voltage of the photoconductor drum 2 which is to be maintained at 400V.

Thus, according to the above-mentioned embodiment, the two corona chargers 4 and 5 each having a plurality of corona discharge wires are arranged around the photoconductor drum 2 and the surface of the photoconductor drum 2 is charged to a constant voltage. Therefore, the rigidity of the chassis of the corona chargers 4 and 5 can be preserved, so that the distance from the respective discharge wires to the surface of the photoconductor drum can be maintained constant and, therefore, the surface of the photoconductor drum can be uniformly charged at a predetermined voltage.

Referring now to FIGS. 9 to 21, some embodiments which can be used in a printer of this invention will now be described. The developing apparatus 110 uses a two-component developer. The toner is supplied from the toner hopper 116 to a unit case 117 of the developing apparatus and fed by two feed paddles 118 to a first agitating screw 119, where the toner is fed in the axial direction thereof, mixed with the developer in the unit case 117 and further fed from the end of the first agitating screw 119 to a second agitating screw 119.

On the other hand, in the developing apparatus 110, the developer fed to the second agitating screw 120 is further agitated by this second agitating screw 120 while being fed in the axial direction thereof opposite to the feeding direction of the first agitating screw 119. Then, the developer is conveyed by the conveyor roll 121 to the surfaces of three magnet rolls 122 and attached thereto.

In addition, in the developing apparatus 110, the residual developer attached to the sheet from the developing magnet rollers 112 is collected by attracting the same to the recovery magnet roll 123.

Figure 9:
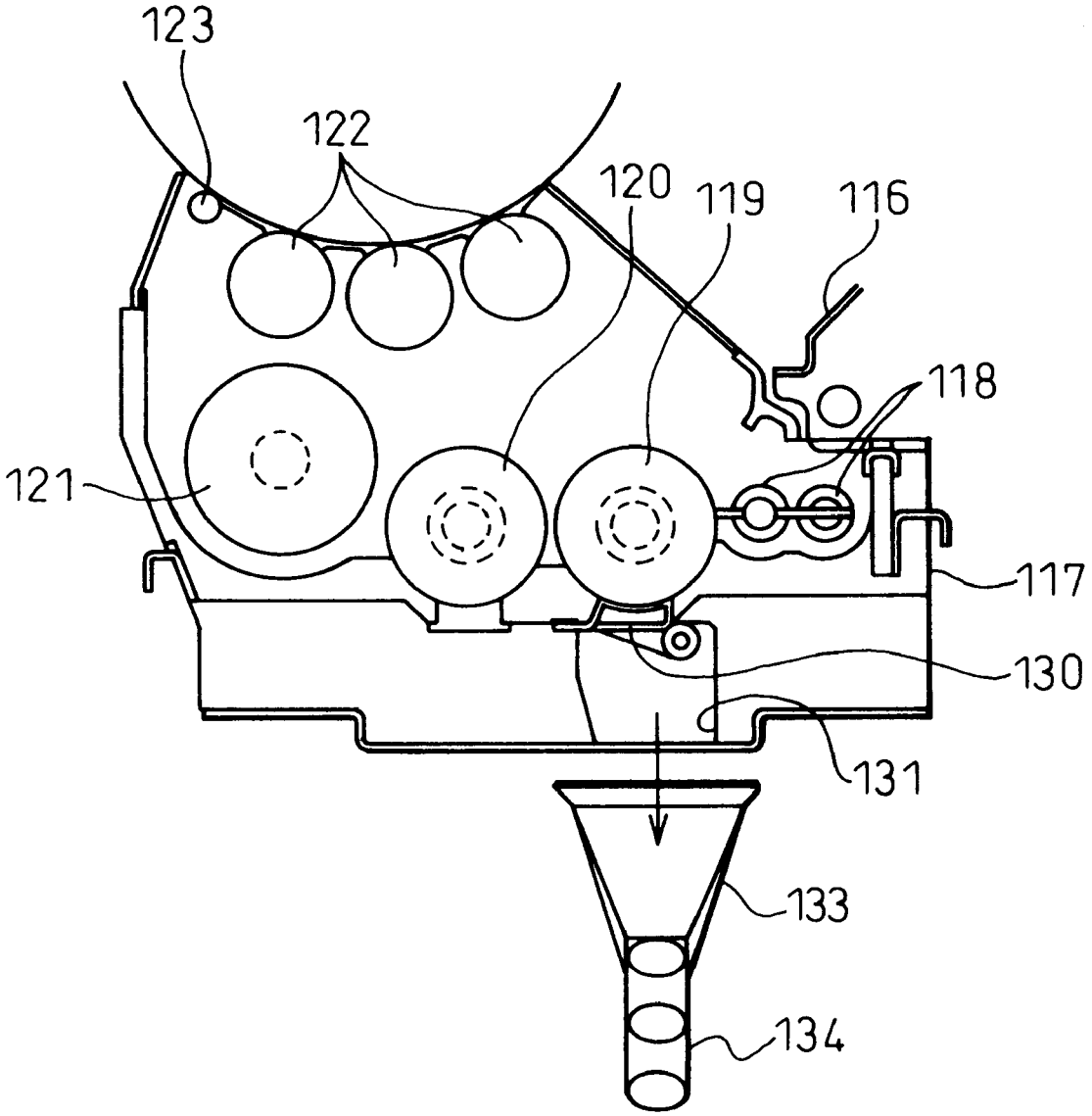
FIG. 9 is a front elevational view showing the main part of a developing apparatus according to the present invention.
Figure 10:
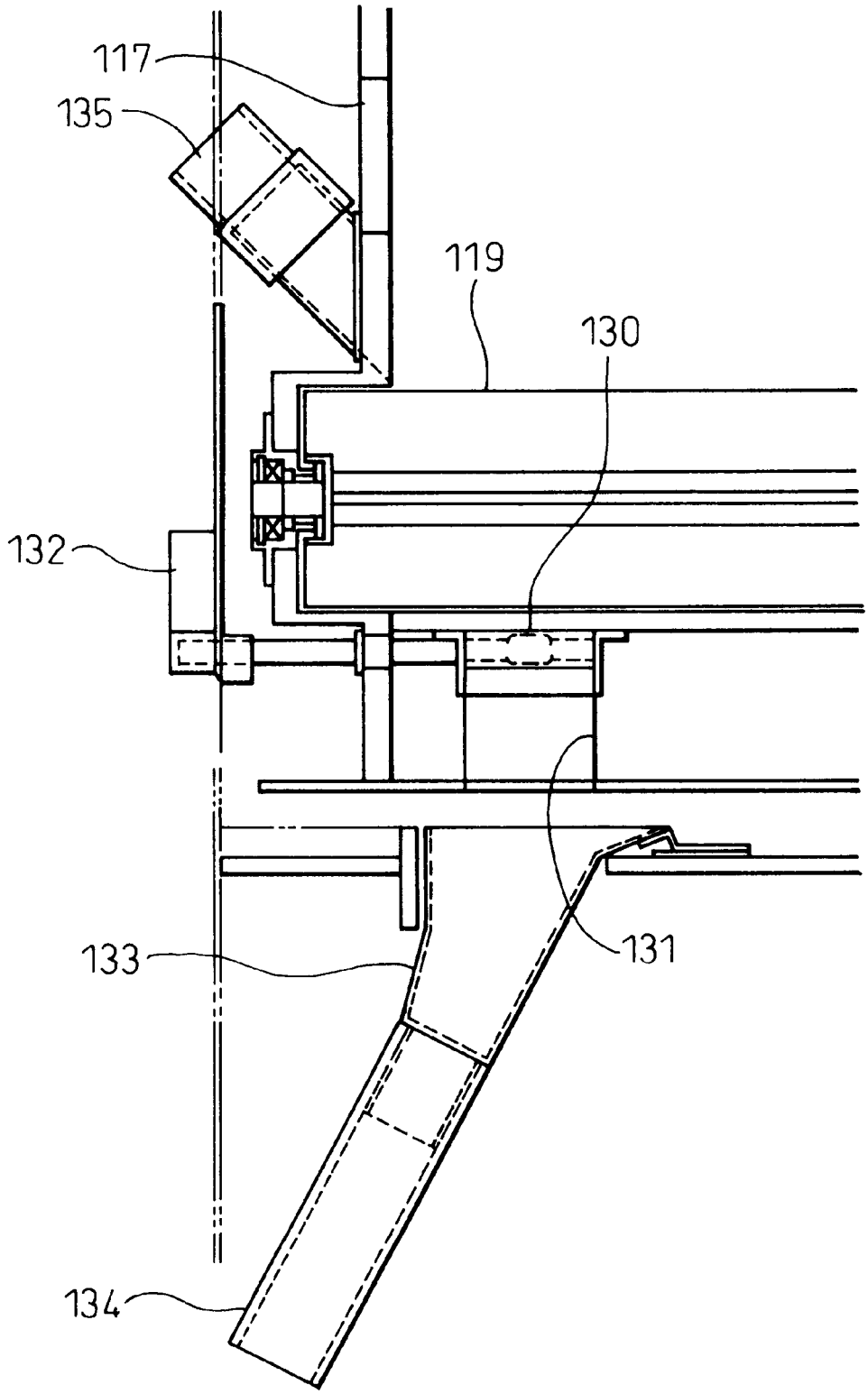
FIG. 10 is a side elevational view showing the main part of the developing apparatus.

As shown in FIGS. 9 and 10, the vertical elevational views, the unit case 117 is provided at an end position of developer feed direction of the first agitating screw 119 with a developer outlet port opened or closed by a lid 130. A developer outlet lever 132 is provided in front of the unit case 117 for operating the rid 130 and also a sensor is provided for detecting the open/close condition of the lid 130.

Figure 11:
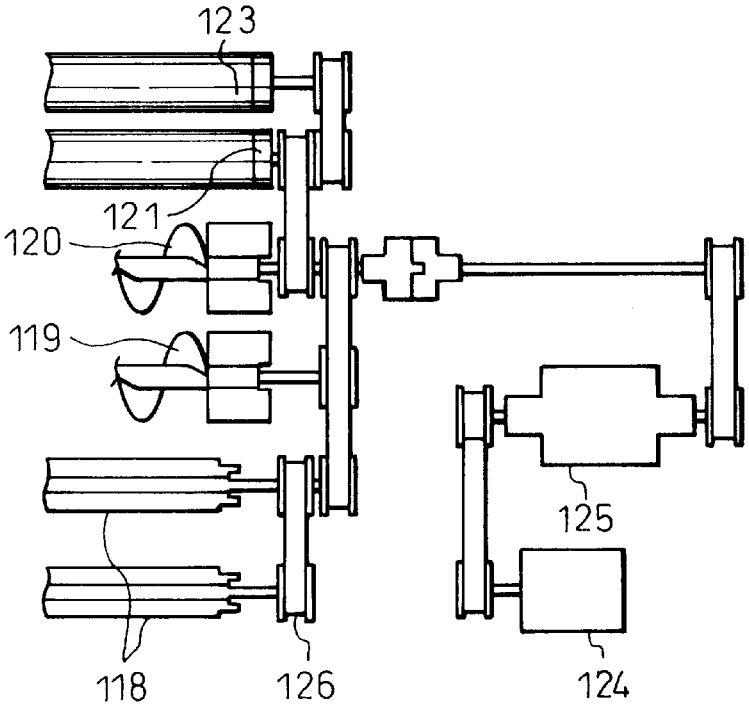
FIG. 11 is a schematic illustration of an agitator drive unit of the developing apparatus.
Figure 12:
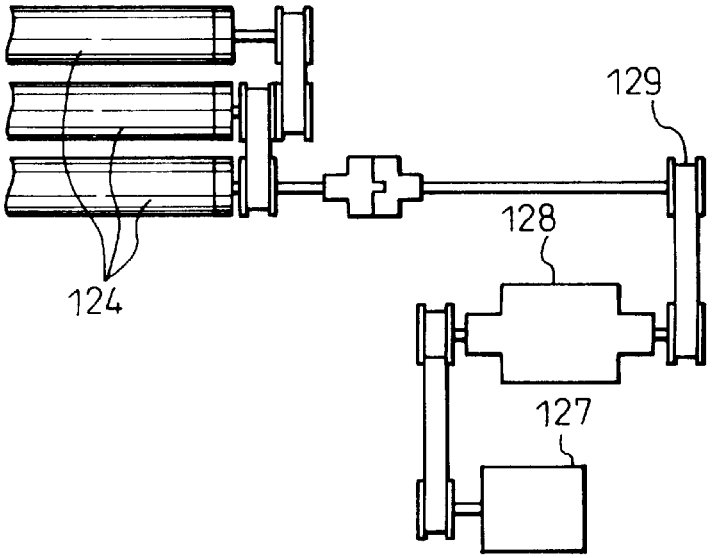
FIG. 12 is a schematic illustration of developing drive unit of the developing apparatus.

As shown in FIG. 11, the above-mentioned two feed paddles 118, the first agitating screw 119, the second agitating screw 120, the conveyor roll 121 and the recovery magnet roll 123 are always rotated at predetermined speeds, in a job of this printer, by means of an agitating motor 124 via a transmission means 126 including a reduction mechanism 125. On the other hand, the above-mentioned three developing magnet rolls 122 are rotated only during the developing operation by another motor 127 different from the agitating motor 124 via a transmission means 129 including a reduction mechanism 128.

In this embodiment, the speed of the continuous sheet is predetermined to be, for example, 1155 mm/sec., the respective developing magnet rollers are rotated at a high speed of 390 rpm and the first and second agitating screws 119 and 120 are rotated at a high speed of 232 rpm.

As shown in FIGS. 9 and 10, a funnel 131 is arranged under the developer outlet port 131 and opened more widely than the developer outlet port 131. An upper end of the hose 134 is connected to this funnel 131. The lower end of this hose 134 extends outward of this printer and inserted into a recovery bottle.

To collect the deteriorated developer from the developing apparatus 110, the lower end of this hose 134 is first inserted into a port of the recovery bottle. Then, the lid 130 is opened and the first agitating screw 119 is rotated by the agitating motor 124. After all of the deteriorated developer is discharged from the developing apparatus, the lid 130 is closed and the fresh developer is supplied into the unit case 117 of the developing apparatus via a developer inlet port, provided in front of the unit case 117.

It is preferable that the developer changing operation is carried out after the developer deteriorates to a certain extent. Therefore, the developer changing operation can be conducted not only when the operator determines by himself the deterioration of the developer by observing the quality of toner image recorded on the printing sheet, but also when the deterioration of the developer is detected by the charged conditions of the developer in the unit case 117 and an indication means of the operating panel 136 automatically indicates a message to inform the operator that the developer must be changed.

In this embodiment, in order that the toner changing operation is to be more precisely carried out by the operator without mistake, the above-mentioned indication means of this printer also indicates questions to the operator in the respective stages of the toner changing operation.

Figure 13:
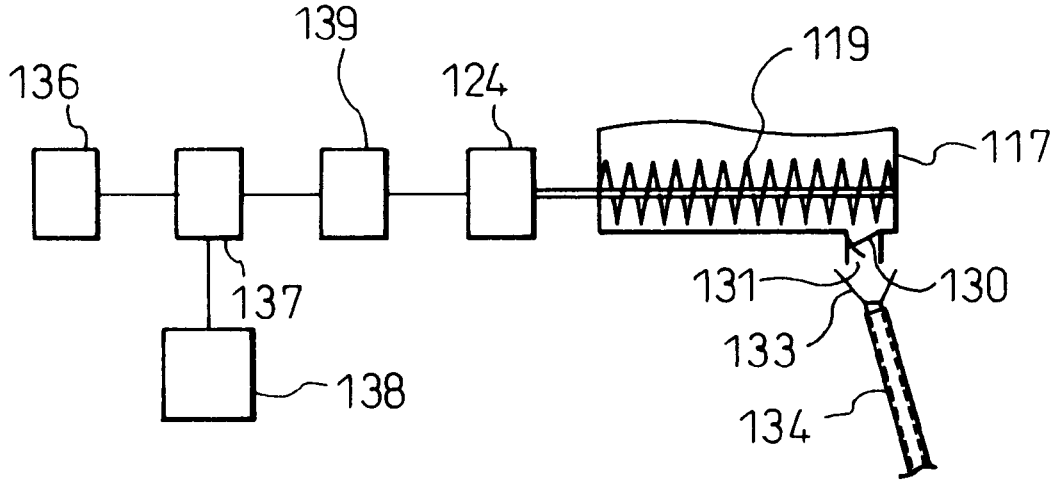
FIG. 13 is a block diagram of a circuit.

In an embodiment of the developing apparatus of this invention, as shown in FIG. 13, a developer case 117 has a bottom surface thereof provided with a developer outlet port 131 which can be opened or closed by a lid 130. A screw 119 is arranged in the developer case 117 for feeding the developer therein toward the developer outlet port 131 by a driving means for driving the screw 119. The driving means comprises a motor 124 for driving the screw 119 and a motor control means 139 for controlling so as to intermittently drive the motor and/or reduce the motor revolution speed for a certain time period after the motor is started.

The motor 124 used in this embodiment is not limited and may be a AC or DC motor.

The motor control means 139 may be one which intermittently drives the motor for a certain time period after the motor is started, or one which reduces the revolutions per minute of the motor 124 for a certain time period from the motor start point, or one which intermittently drives the motor at a reduced speed for a certain time period from the motor start point.

The motor control means 139 which intermittently drives the motor 124 for a certain time from the motor start may be one which only intermittently turns ON and OFF the drive power current, with the time ratio of ON and OFF being constant, or with the time ratio of ON being gradually increased.

For example, the motor 124 is driven in such a manner that the volume of the developer discharged from the developer outlet port 131 to the funnel 133 is smaller than the volume of the funnel 133. Then, the motor 124 is stopped over the time during which the developer dropped into the funnel 133 flows into the recovery chamber, or for a time slightly less than that. Therefore, the volume of the toner dropped into the funnel 133 cannot become larger than the volume of the funnel 133 and an overflow of the developer out of the funnel 133 is thus prevented.

As the motor control means 139 which reduces the speed of the motor 124 for a certain time period from the motor start point, one which maintain a constant reduced speed for a certain time period from the motor start point, or one which gradually increases the motor speed from the motor start point, can be used.

Therefore, the motor 124 is driven at a reduced speed so that the developer discharged from the developer outlet port 131 into the funnel 133 is prevented from overflowing out of the funnel 133.

As the motor control means 139 which intermittently drives the motor at a reduction speed for a certain time period from the motor start point, there may be four combinations as mentioned above. Namely, the motor 124 is driven in such a manner that; the times of ON and OFF are constant, with the motor being driven at a certain reduced speed during the time of ON; the times of ON and OFF are constant, with the reduced speed of the motor being gradually increased form the motor start point; the time of ON being gradually increased from the motor start point, with the motor being driven at a certain reduced speed during the time of ON; and the time of ON being gradually increased from the motor start point, with the reduced speed of the motor being gradually increased from the motor start point.

As the motor 124 for driving the screw 119, two or more motors having different speeds can be selectively used by the motor control means 139, so that the screw 119 is driven at a reduced speed for a certain time period from the motor start point. However, in order to reduce the number of parts and make the construction simple, it is preferable to use a single motor which is driven intermittently or driven at a reduced speed.

According to this embodiment, the motor is intermittently driven or driven at a reduced speed by the motor control means 139, so that the amount of the developer which is discharged from the developer case is restricted so as not to generate a "bridge" in the funnel or hose. Therefore, even if the funnel or hose is smaller than those of conventionally used, the deteriorated developer can be smoothly discharged without generation of a "bridge" in the funnel or hose.

As shown in a block diagram in FIG. 13, the mechanical controller 137 for controlling the mechanical parts of the printer is connected to the operating panel 136, outlet port information source 138 comprising a sensor for detecting open/closed condition of the rid 130 and a sensor for detecting the deterioration of the developer, and the motor control means 139 for controlling the agitating motor 124.

Figure 16:
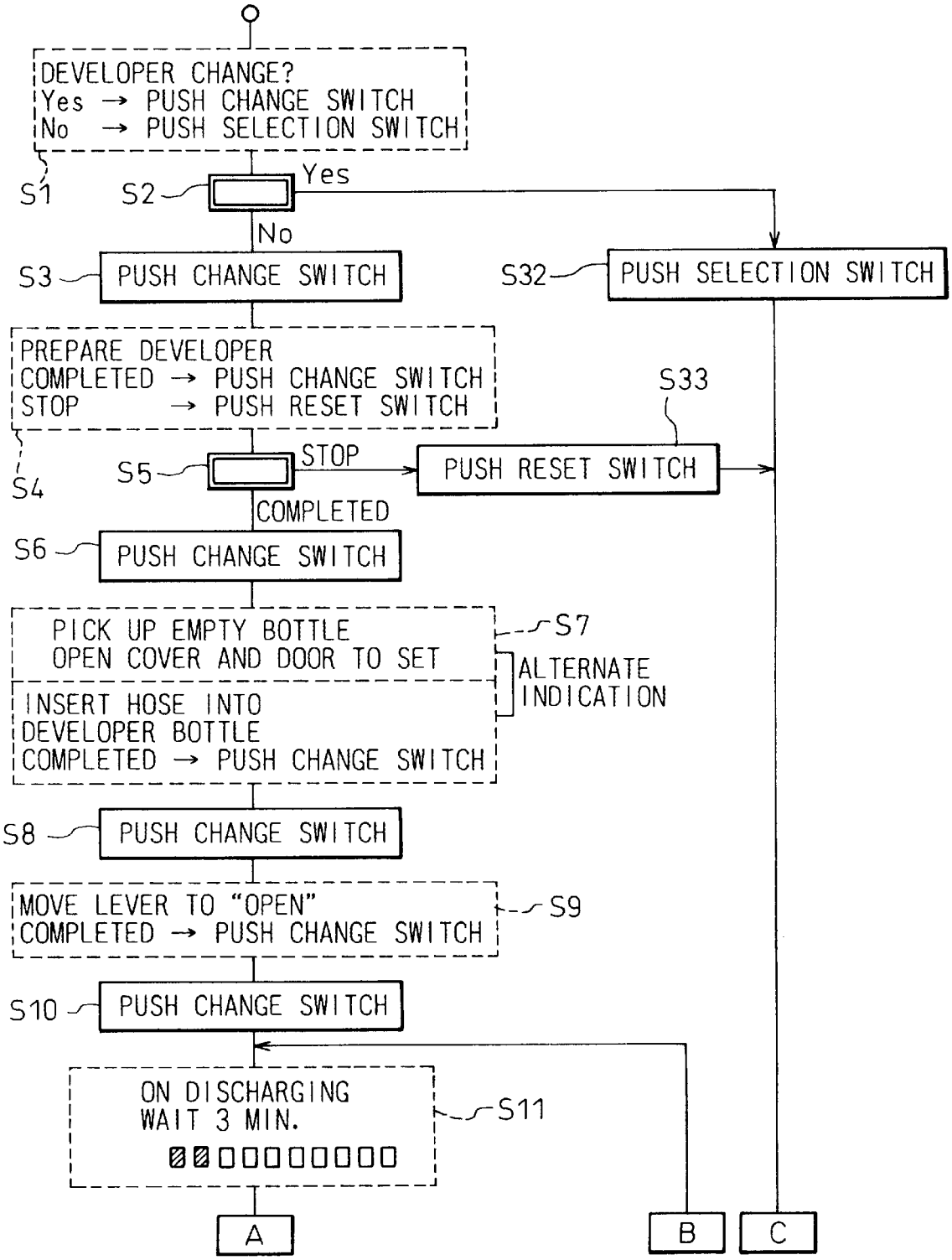
FIGS. 16, 17 and 18 are flow charts illustrating an embodiment of a process for changing the developer according to the present invention.
Figure 17:
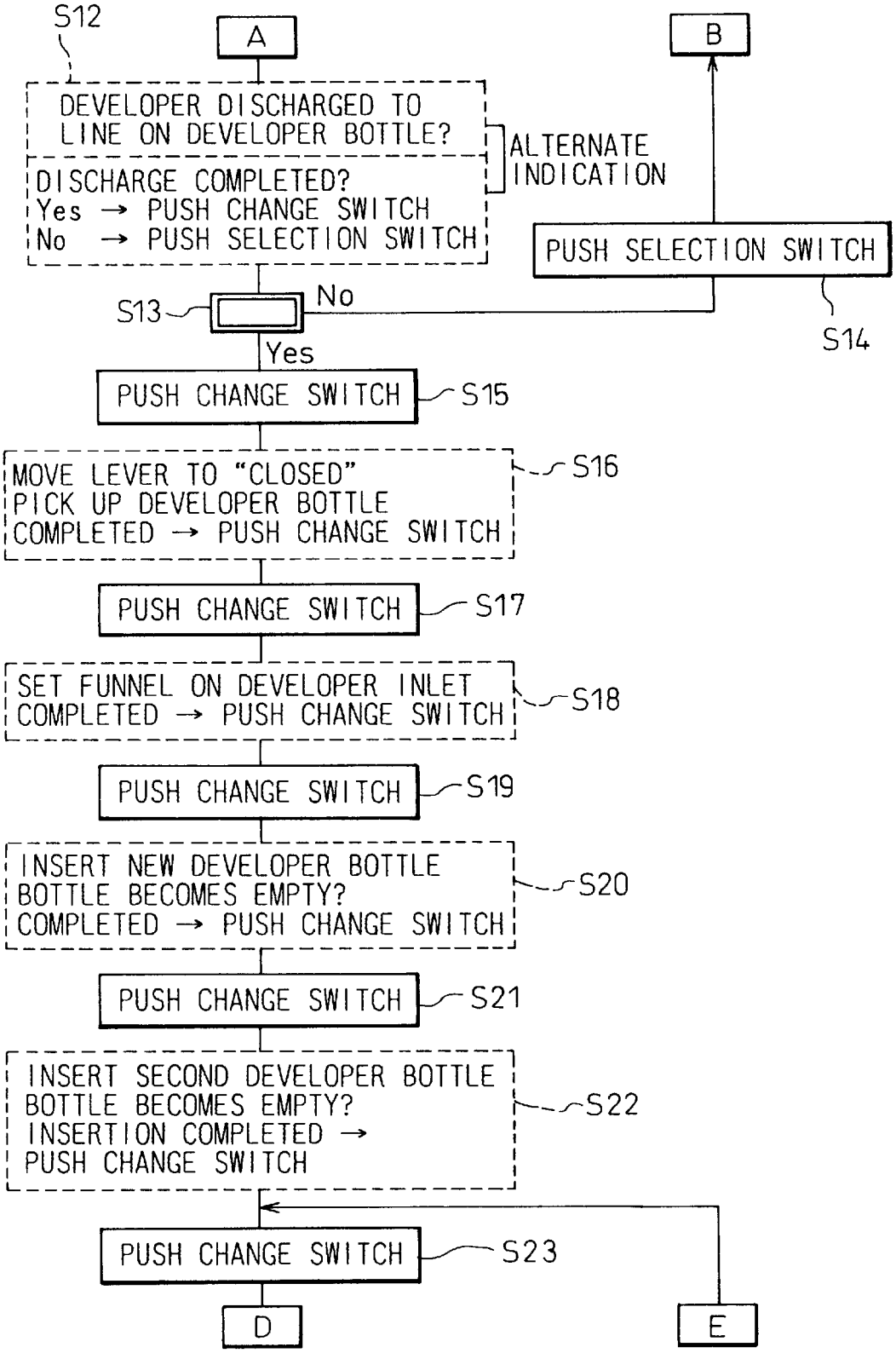
Figure 18:
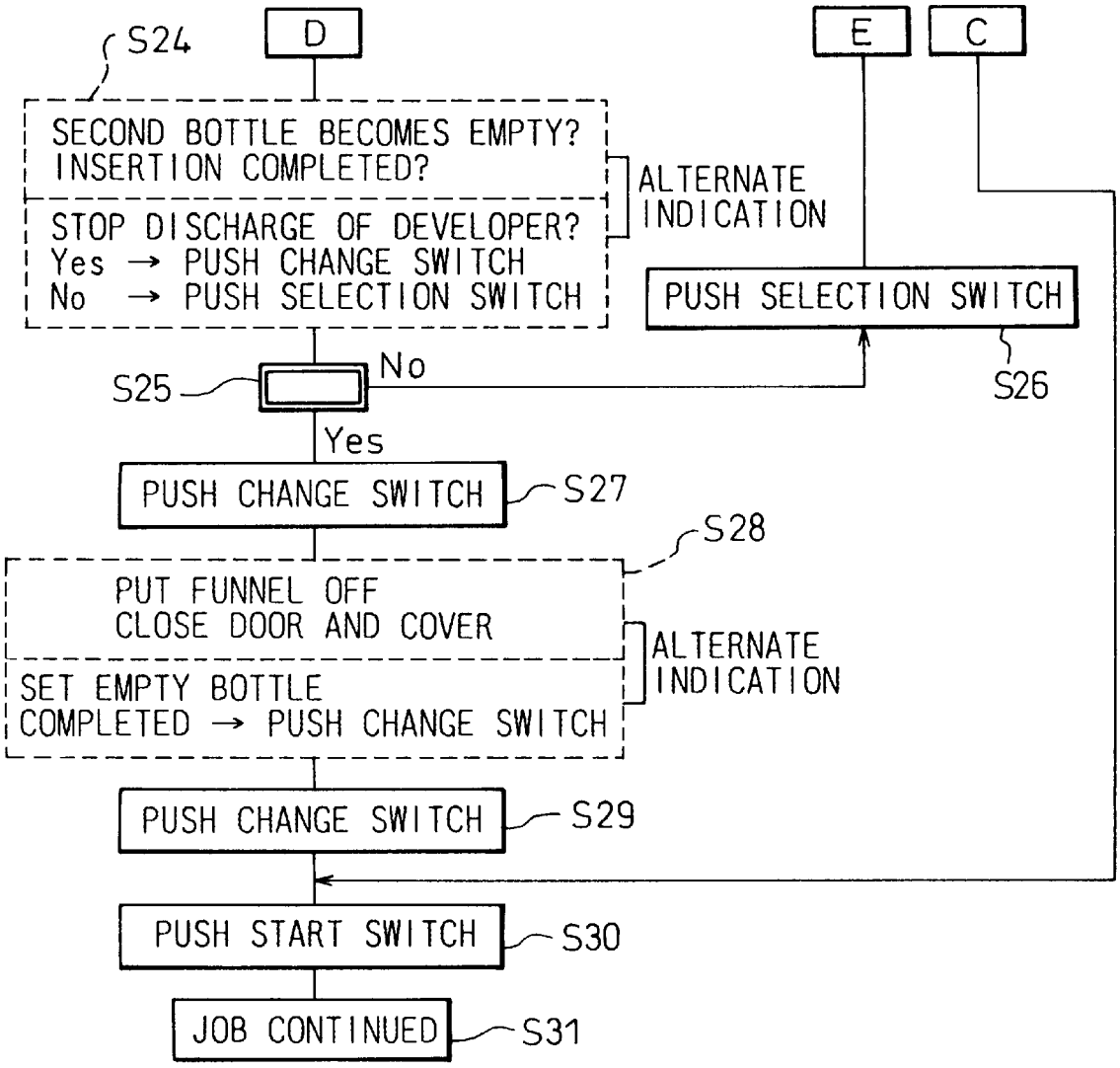
Figure 19:
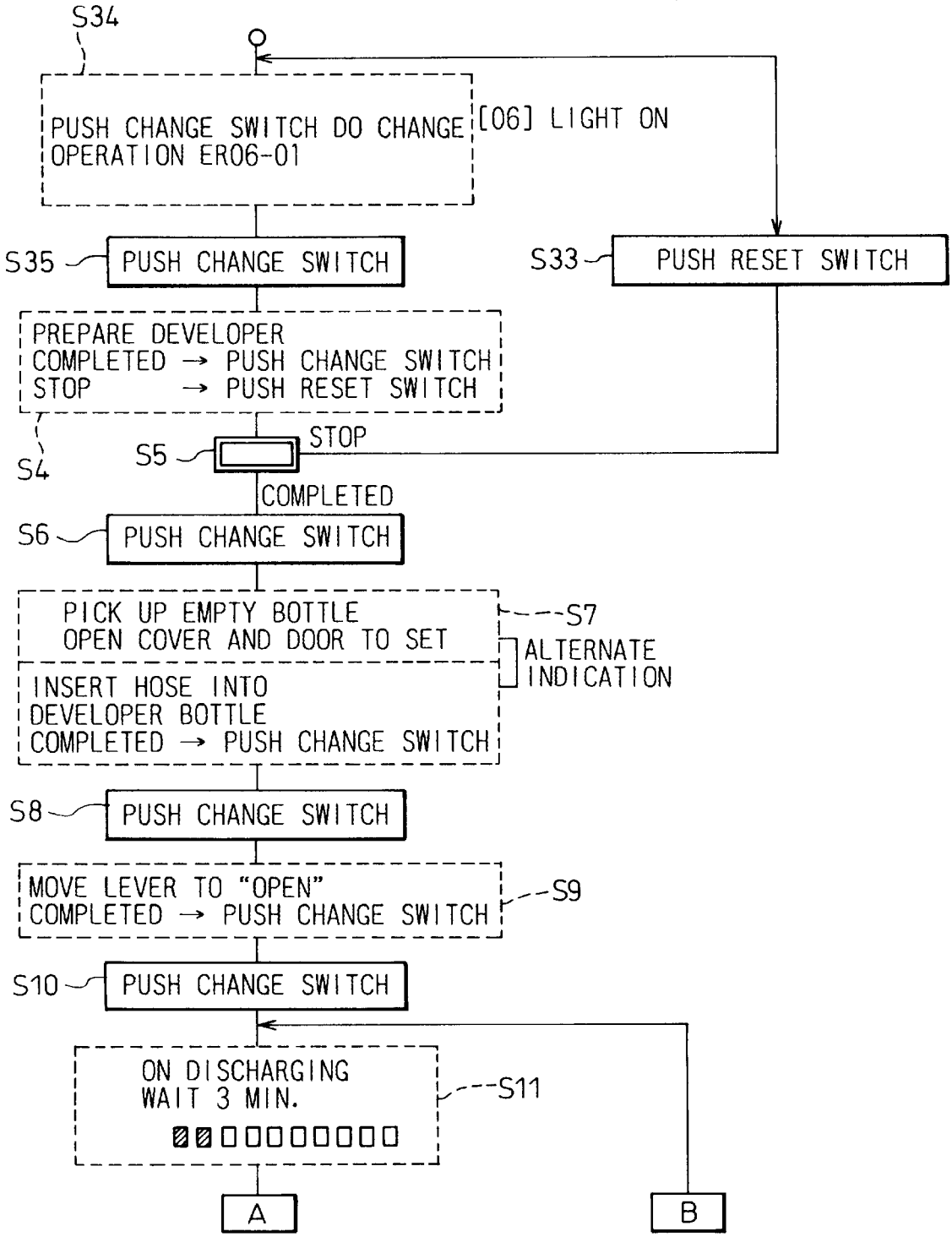
FIGS. 19, 20 and 21 are flow charts illustrating another embodiment of a process for changing the developer according to the present invention.
Figure 20:
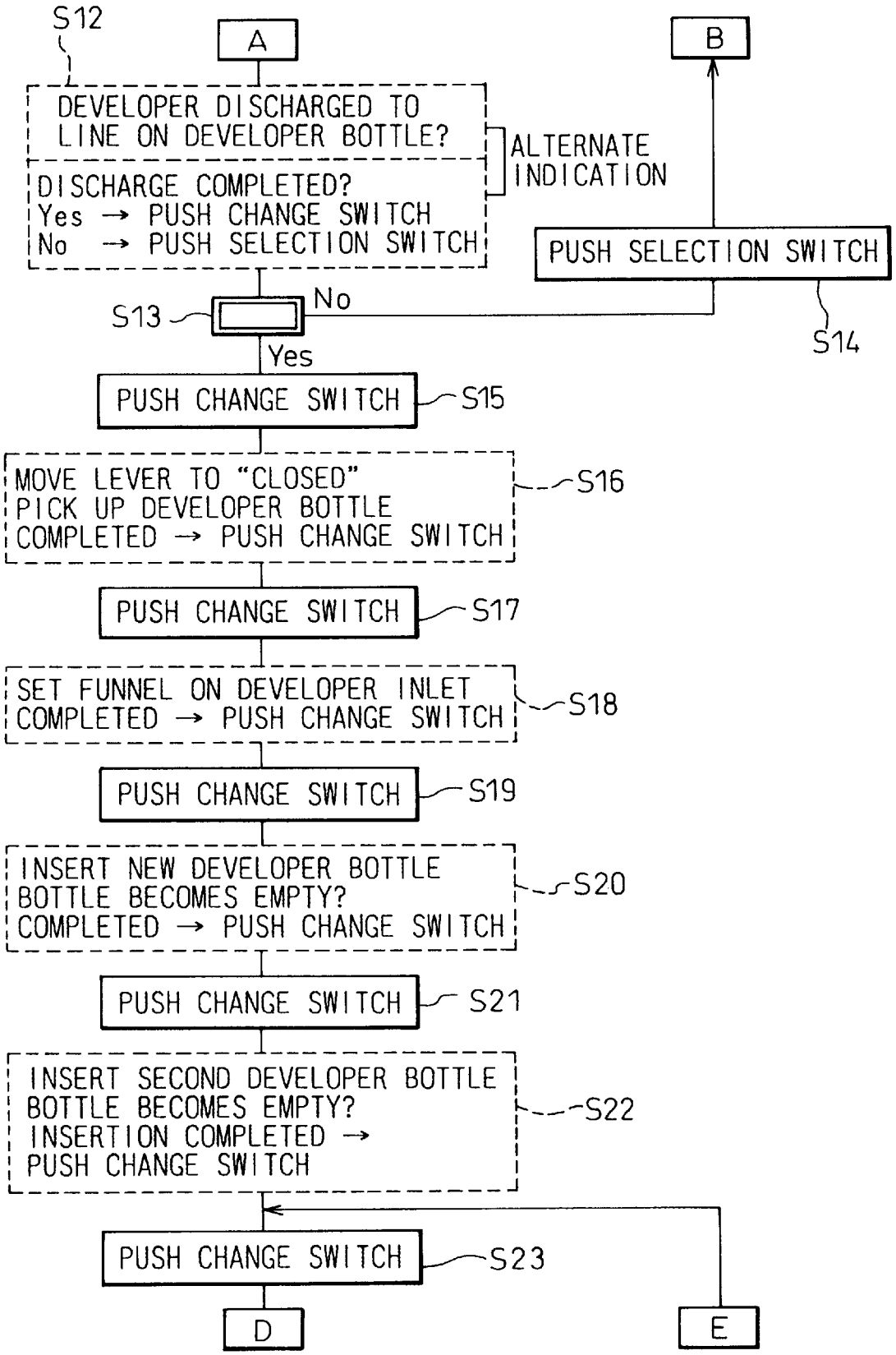
Figure 21:
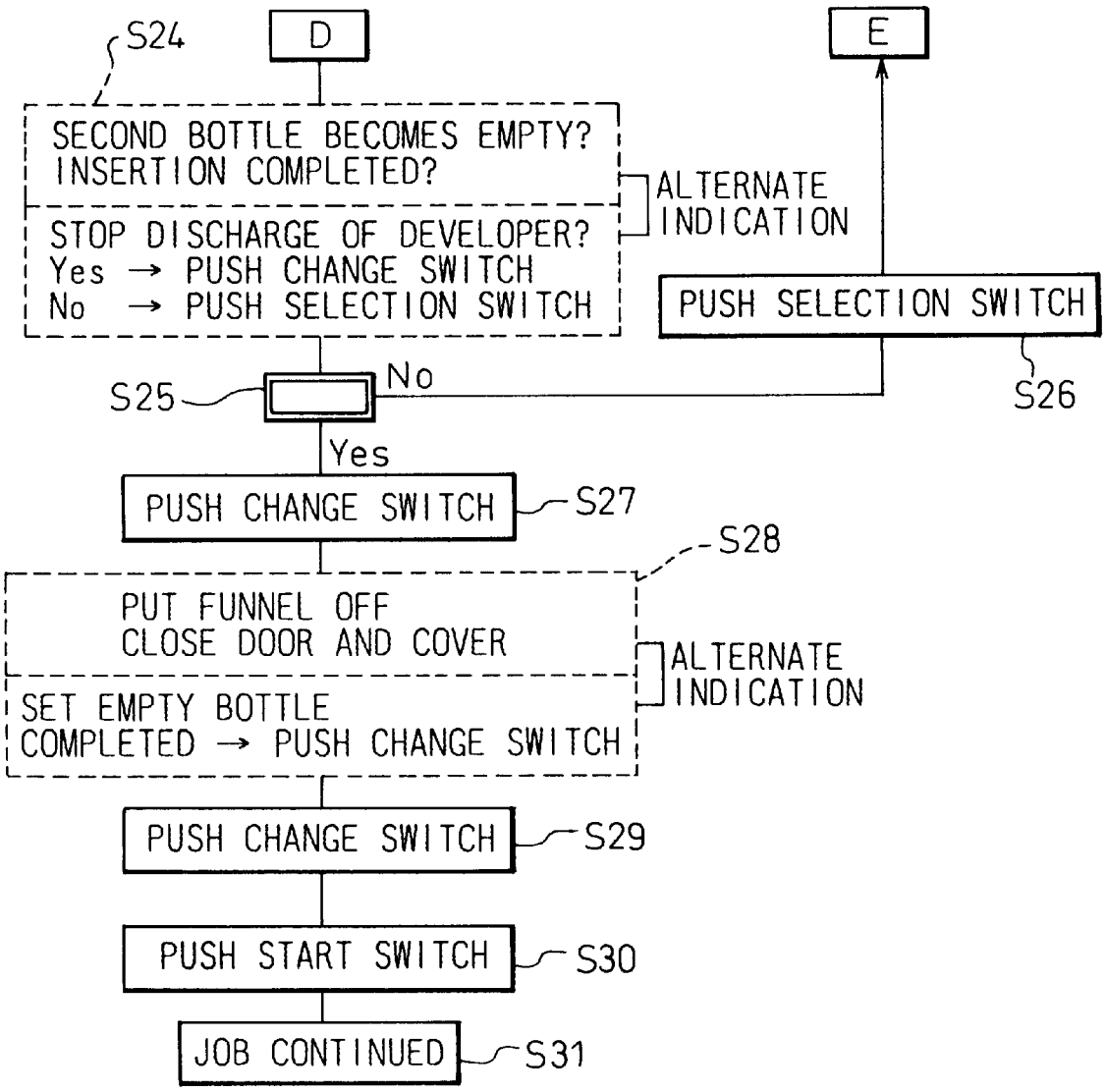

When the operator directly operates the operating panel, or when a signal indicating the deterioration of toner is transmitted from the outlet port information source 138 to the mechanical controller 137, a process of developer change can be performed by the steps shown in FIGS. 16 to 18, or the steps shown in FIGS. 19 to 21.

In the flow diagrams of FIGS. 16 to 21, descriptions in the broken line frames are messages indicated in the above-mentioned indicator, the descriptions in the solid line frames are operations, and the descriptions in the double line frame are selectable by the operator.

If the operator intends to optionally change the developer, such as when the operator detects that the deterioration of the developer has reached certain extent, i.e., to "near life", the printer is stopped, so that an operating condition "00" is indicated on the indicator. Then, the operator elects the change of developer by pushing a supplies election switch on the above-mentioned operating panel 136. Thus, "DEVELOPER CHANGE?" is indicated on the operating panel 136 and the operator confirms this indication of "DEVELOPER CHANGE?". Thus, as shown in FIG. 16, on the operating panel 136, "DEVELOPER CHANGE?; YES→PUSH CHANGE SWITCH; NO→PUSH SELECTION SWITCH" is indicated (S1). In response to this indication, the operator evaluates whether it is necessary or not necessary to change the developer (S2). If necessary (YES), the supplies election switch provided on the operating panel 136 is pushed (S3).

When the supplies election switch is pushed, on the operating panel 136, "PREPARE DEVELOPER; COMPLETED→PUSH CHANGE SWITCH; STOP→PUSH RESET SWITCH" is indicated (S4). Then, the operator detects that the preparation has been completed (S5) and push the supplies election switch (S6). Thus, on the operating panel 136, "PICKUP EMPTY BOTTLE; OPEN COVER AND DOOR TO SET" and "INSERT HOSE INTO DEVELOPER BOTTLE COMPLETED; COMPLETED→PUSH CHANGE SWITCH" are alternately indicated by a certain cycle (S7).

In accordance with these indications, the operator pickups an empty bottle for collecting the developer from the printer case, sets this empty bottle on a predetermined position of the front part of the printer case, and insert the lower end of the hose into this empty bottle.

After this operation is completed, the operator pushes the supplies change switch (S8), so that "MOVE LEVER TO "OPEN"; COMPLETED→PUSH CHANGE SWITCH" are indicated on the operating panel 136 (S9). In accordance with this indication, when the operator changes the developer discharge lever 132 to the open side, the lid 130 is opened.

After the operator changes the developer discharge lever 132 to the open side, the operator pushes down the supplies election switch (S10), so that the above-mentioned agitating motor 124 is started. Thus, the developer is transported by the first agitating screw 119 toward the developer outlet port 131, through which the developer falls down into the funnel 133 and is then collected through the hose 134 in the empty bottle.

Figure 14:
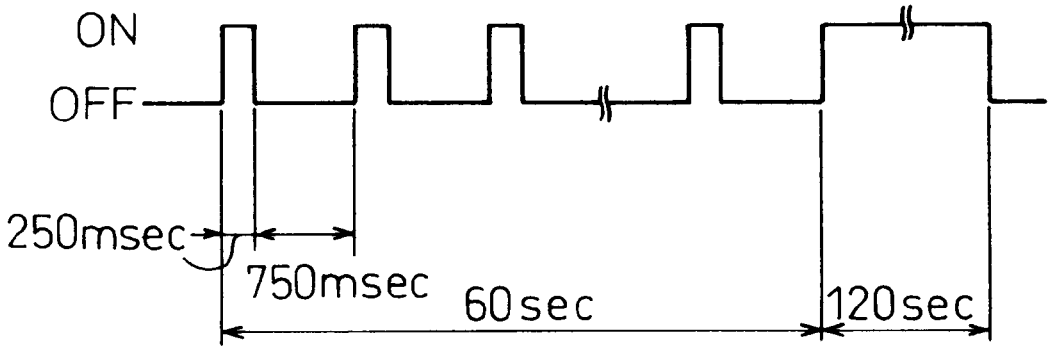
FIG. 14 is an illustration of controlling part of a motor controller.

It is important that the above-mentioned motor controller 139 supplies an electric current having a pulse width of 250 m sec to the agitating motor 124 for 60 sec from the motor start, as shown in the control chart of FIG. 14, after that the supply of electric current is stopped for over 250 m sec, and such control is repeated. Thus, periodic driving is conducted in such a manner that, after the agitating motor 124 is rotated for 10 revolutions, the motor is stopped for 750 m sec.

While the agitating motor 124 is rotated for 10 revolutions, the first agitating screw 119 is rotated for one revolution and discharges the developer to a maximum of 139 $cm^3$ through the developer outlet port 131. If the volume of the funnel 133 is larger than that, no problems will occur. In this embodiment, since the volume of the funnel 133 is 187 $cm^3$, an amount of the developer corresponding to 74.3% of the volume of the funnel 133 falls down into the funnel 133. Then, the developer in the funnel 133 flows from the funnel 133 to the hose 134 within about 1 sec or less. Even if the next developer is falls down into the funnel after about 750 sec expires, the developer is prevented from overflowing out of the funnel 133 since the former developer flows from the funnel 133 into the hose 134 before the next developer falls into the funnel 133. Also, since the hose 133 has an inner diameter which is the same as or larger than that of outlet of the funnel 133, the developer discharged from the hose 134 to the funnel 133 can be collected into the empty bottle without jamming.

Figure 15:
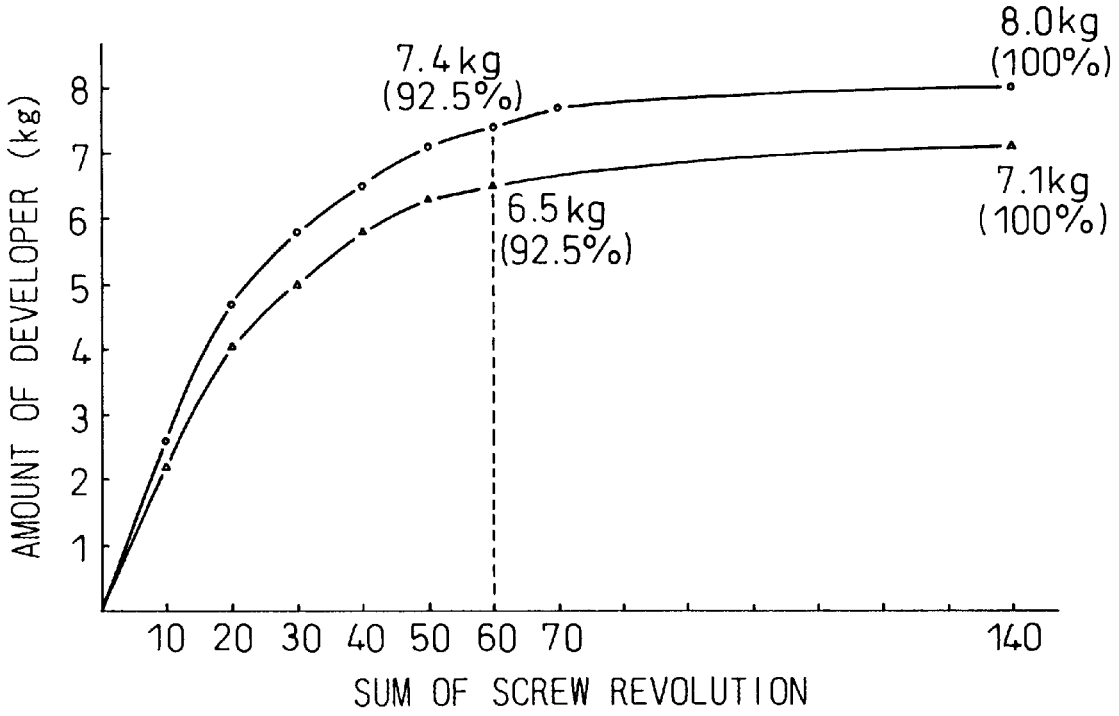
FIG. 15 is a graph showing the relationship between the screw revolution and an amount of discharge.

The first agitating screw 119 is rotated for 60 revolutions during 60. As shown in FIG. 15 which is a diagram showing the relationship between the sum of the screw revolution and the amount of developer, about 91.5% to 92.5% of the developer in the developer case 117 is discharged by the 60 revolutions of the agitating screw 119. Although the agitating screw 119 may further be intermittently driven for a predetermined time period, in this embodiment, the agitating screw 119 is continuously driven in order to discharge the residual developer in a short time. The first agitating screw 119 is driven at a full speed during intermittent running as well as during continuous running.

As shown in FIG. 16, while the developer is discharged, on the indicator "ON DISCHARGING; WAIT 3 MIN." is indicated and also the time expired is indicated by the length of the light up lines (S11). After three minutes have passed, as shown in FIG. 17, on the above-mentioned indicator, the indication of "DEVELOPER DISCHARGED TO LINE ON DEVELOPER BOTTLE?" and the indication "DISCHARGED COMPLETED?; YES→PUSH CHANGE SWITCH; NO→PUSH SELECTION SWITCH" are alternately indicated (S12).

In accordance with these indications, the operator confirms whether or not the developer is discharged from the discharge amount confirmation line presented on the developer bottle. When the amount of discharge has not been reached to the confirmation line, the continuous discharge of the developer is still necessary and, therefore, the operator confirms "NO" (S13) and thus pushes down the supplies selection switch (S14). Thus, the process returns to the step wherein "ON DISCHARGING; WAIT 3 MIN." is indicated again on the indicator and also the time expired is indicated by the length of the light up lines (S11). After that and three minutes has passed, on the indicator "DEVELOPER DISCHARGED TO LINE ON DEVELOPER BOTTLE?" and the indication "DISCHARGED COMPLETED?; YES→PUSH CHANGE SWITCH; NO→PUSH SELECTION SWITCH" are alternately indicated (S12).

When the operator confirms, in accordance with the above-mentioned indications, that the developer is discharged until the level thereof reaches to the discharge amount confirmation line presented on the developer bottle, the operator recognizes "YES" (S15) and thus pushes down the supplies change switch (S14). Thus, the indicator indicates that "MOVE LEVER TO "CLOSE"; PICKUP DEVELOPER BOTTLE; COMPLETED→PUSH CHANGE SWITCH" (S16). In accordance with this indication, the operator changes the developer discharge lever 132 to the closed side and picks up the bottle in which the developer is collected. When the operator down the supplies change switch (S17), the indicator indicates that "SET FUNNEL ON DEVELOPER INLET; COMPLETED→PUSH CHANGE SWITCH" (S18).

In accordance with this indication, the operator sets the developer supply funnel on the developer inlet port 135. The operator pushes down the supplies change switch (S19), so that the indicator indicates that "INSERT NEW DEVELOPER BOTTLE; COMPLETED→PUSH CHANGE SWITCH" (S20). After the operator insert the first new developer bottle and pushes down the supplies change switch (S21), the indicator indicates that "INSERT SECOND NEW DEVELOPER BOTTLE; BOTTLE BECOMES EMPTY? INSERTION COMPLETED→PUSH CHANGE SWITCH" (S22).

When the operator sets the second developer bottle and pushes down the supplies change switch (S23) in accordance with this indication, on the indicator "SECOND BOTTLE BECOMES EMPTY? INSERTION COMPLETED?" and "INSERTION COMPLETED? YES→PUSH CHANGE SWITCH; NO→PUSH SELECTION SWITCH" are alternately indicated (S24).

In accordance with these indications, when the operator decides to continue supply of the developer (S25), the operator pushes down the supplies selection switch (S26) and inserts a further new developer bottle and pushes down the supplies change switch (S23). Thus, on the indicator "SECOND BOTTLE BECOMES EMPTY? INSERTION COMPLETED?" and "INSERTION COMPLETED? YES→PUSH CHANGE SWITCH; NO→PUSH SELECTION SWITCH" are again alternately indicated (S24).

When the operator decides to stop supply of the developer (S25) according to these indications and pushes down the supplies change switch (S27), the indicator alternately indicates "PUT FUNNEL OFF; CLOSE DOOR AND COVER" and "SET EMPTY BOTTLE; COMPLETED→PUSH CHANGE SWITCH" (S28). When the operator puts the developer supply funnel off, closes the intermediate door and the central right cover, and further sets an empty bottle on a back cover of the apparatus stacker, the operator pushes down the supplies change switch (S29). Thus, the developer changing operation has been now completed. Then, the operator pushes down the start switch on the operating panel 136 (S30), the job of this printer is continued (S31).

As shown in FIG. 16, when the operator evaluates that it is not necessary to change the developer (S2) and therefore pushes down the supplies selection switch (S32), or when the operator decides that it is necessary to change the developer (S2) and pushes down the supplies election switch (S3), but decides to stop the change of developer without preparing the developer (S5) and therefore pushes down the reset switch on the operating panel 136 (S33), the job of this printer is further continued by pushing down the start switch, as shown in FIG. 18.

If the deterioration of the developer is detected, as shown in FIG. 19, on the indicator "06" lights up as an indication of condition. With this indication, on the indicator, "(DETERIORATION OF DEVELOPER) PUSH CHANGE SWITCH; DO CHANGE OPERATION ER06-01" is indicated (S34).

In accordance with this indications, the operator pushes down the supplies change switch (S35). Thus, on the operating panel 136, "PREPARE DEVELOPER; COMPLETED→PUSH CHANGE SWITCH; STOP→PUSH RESET SWITCH" is indicated (S4). Then, the operator evaluates that the preparation has been completed (S5) and pushes the supplies election switch (S6).

Thus, "PICKUP EMPTY BOTTLE; OPEN COVER AND DOOR TO SET" and "INSERT HOSE INTO DEVELOPER BOTTLE COMPLETED; COMPLETED→PUSH CHANGE SWITCH" are alternately indicated by a certain cycle (S7). Thereafter, the developer changing operation is conducted in the same manner as the above-mentioned steps (S7–S29) in which the operator optionally conducts the developer changing operation.

If the operator evaluates that the developer changing operation should be stopped (S5) and pushes the reset switch (S33, the process is returns to the step wherein "(DETERIORATION OF DEVELOPER) PUSH CHANGE SWITCH; DO CHANGE OPERATION ER06-01" is indicated on the indicator (S34).

Figure 22:
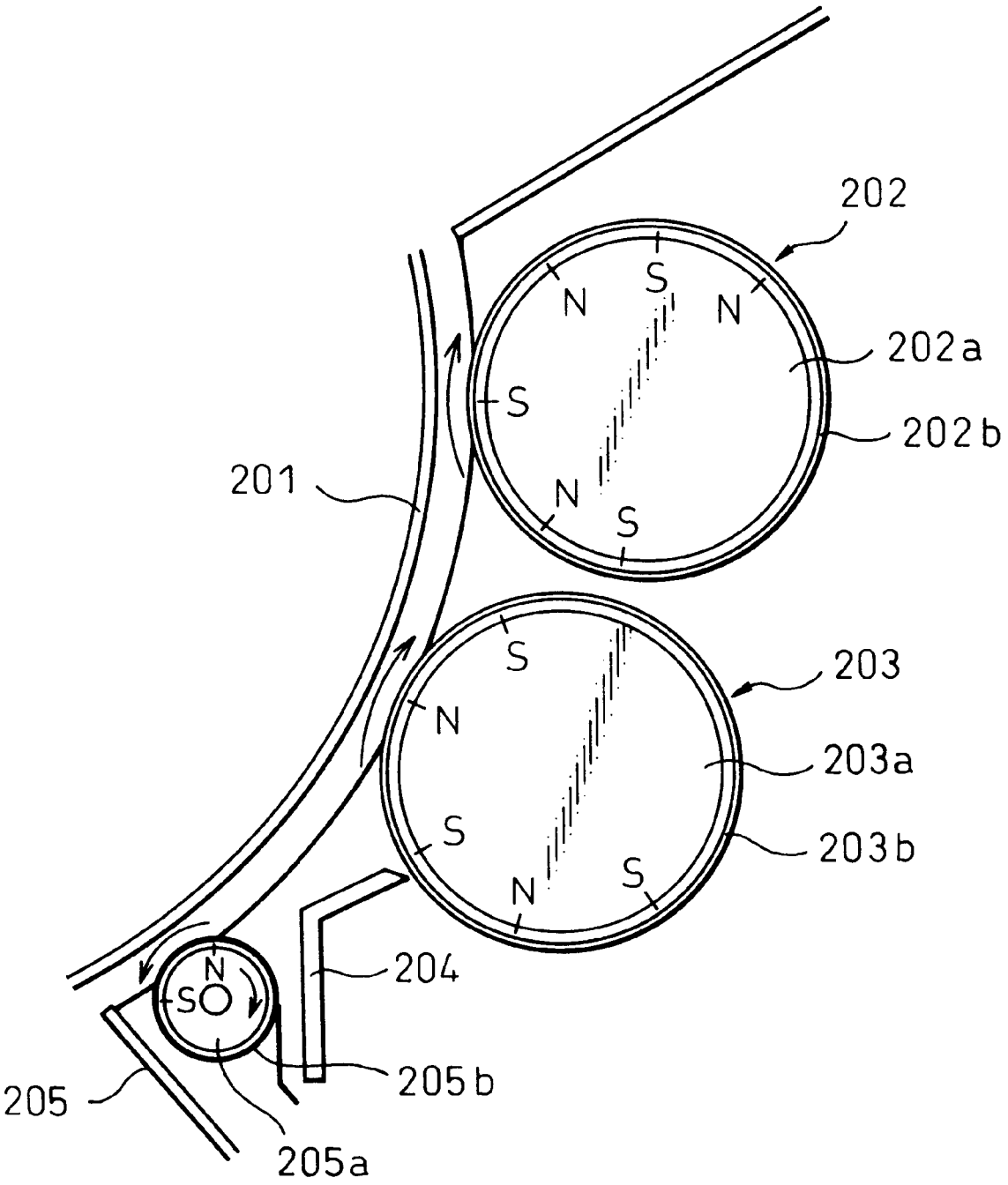
FIG. 22 is a partial view of a developing unit of an electronic photographic apparatus according to the present invention.

FIG. 22 shows an embodiment of a developing apparatus which comprises a photoconductor drum 201 as an electrostatic latent image carrying body. A first developing roller 203 comprises a stationary magnet roller 203*a* and a sleeve 203*b* rotatable therearound. A collecting roller 205 comprises a stationary magnet roller 205*a* and a sleeve 205*b* rotatable therearound. These developing rollers exert magnet force and therefore a magnetic field is formed in the vicinity of a doctor blade 204.

Thus, in the magnetic field around the doctor blade 204, there is an area where the first developing roller 203 attracts more strongly than the other, another area where the collecting roller 205 attracts more strongly than the other, and still another area where both forces are balanced or no magnetic force is exerted.

Therefore, if the developer is scattered and dropped toward the area where magnetic forces are balanced or no magnetic force is exerted, the developer is accumulated in that area since no rollers attract the developer.

Thus, the area where magnetic forces are balanced or no magnetic force is exerted is shifted by the magnetic force, such as magnetic forces of the magnet rollers 203*a* and 205*a*, or by any external magnetic force. That is to say, if the relationship between the developing roller (magnet roller) 203*a* and the collecting roller (magnet roller) 205*a* is N-S poles, the collecting roller (magnet roller) is rotated so as to be N-N poles; and if N-N poles, N-S poles. Otherwise, another magnetic force is created in the magnetic field so that the developer is attracted to any one of the rollers.

In the developing apparatus shown in FIG. 22, the magnetic field in the vicinity of the doctor blade is changed so that the non-magnetic portion or the balanced portion, in the vicinity of doctor blade 204, caused by the magnetic force of the developing roller 203*a* and the magnetic force of the collecting roller 205*a* is shifted. Thus, the developer is shifted toward the developing roller 203 or toward the collecting roller 205, so that the amount of the developer accumulated on the doctor blade 204 can be reduced.

Figure 23:
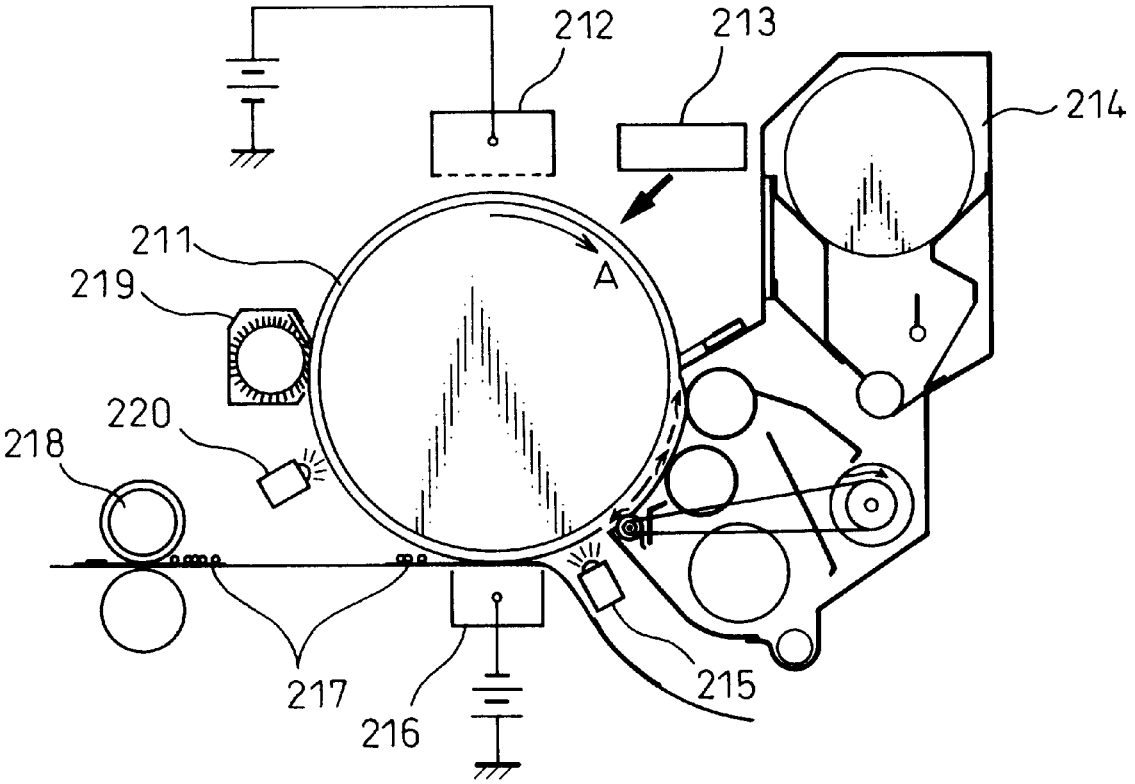
FIG. 23 is an overall illustration of an electronic photographic apparatus provided therein with a first embodiment of a developing apparatus.
Figure 24:
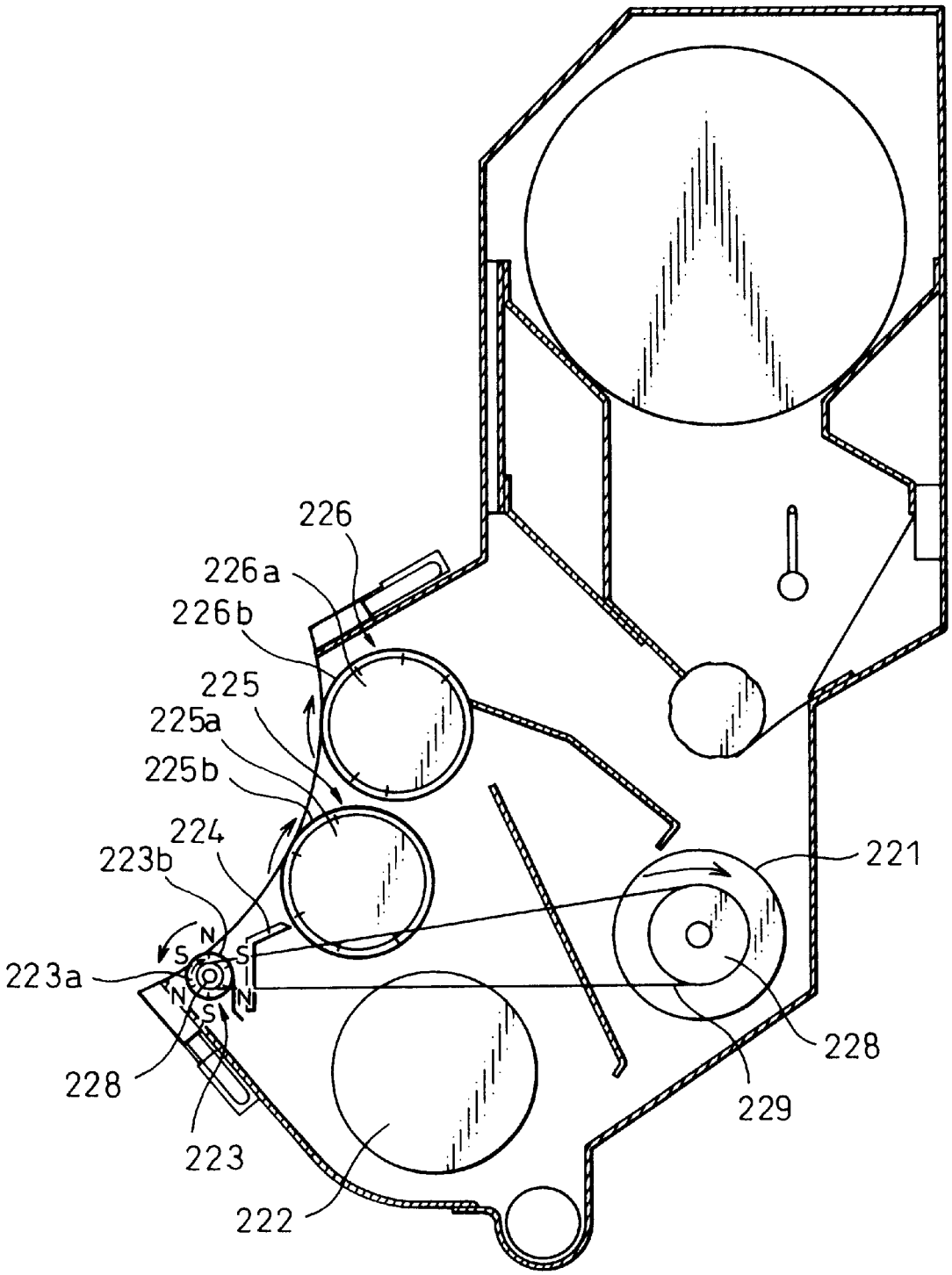
FIG. 24 shows the first embodiment of a developing apparatus.
Figure 25:
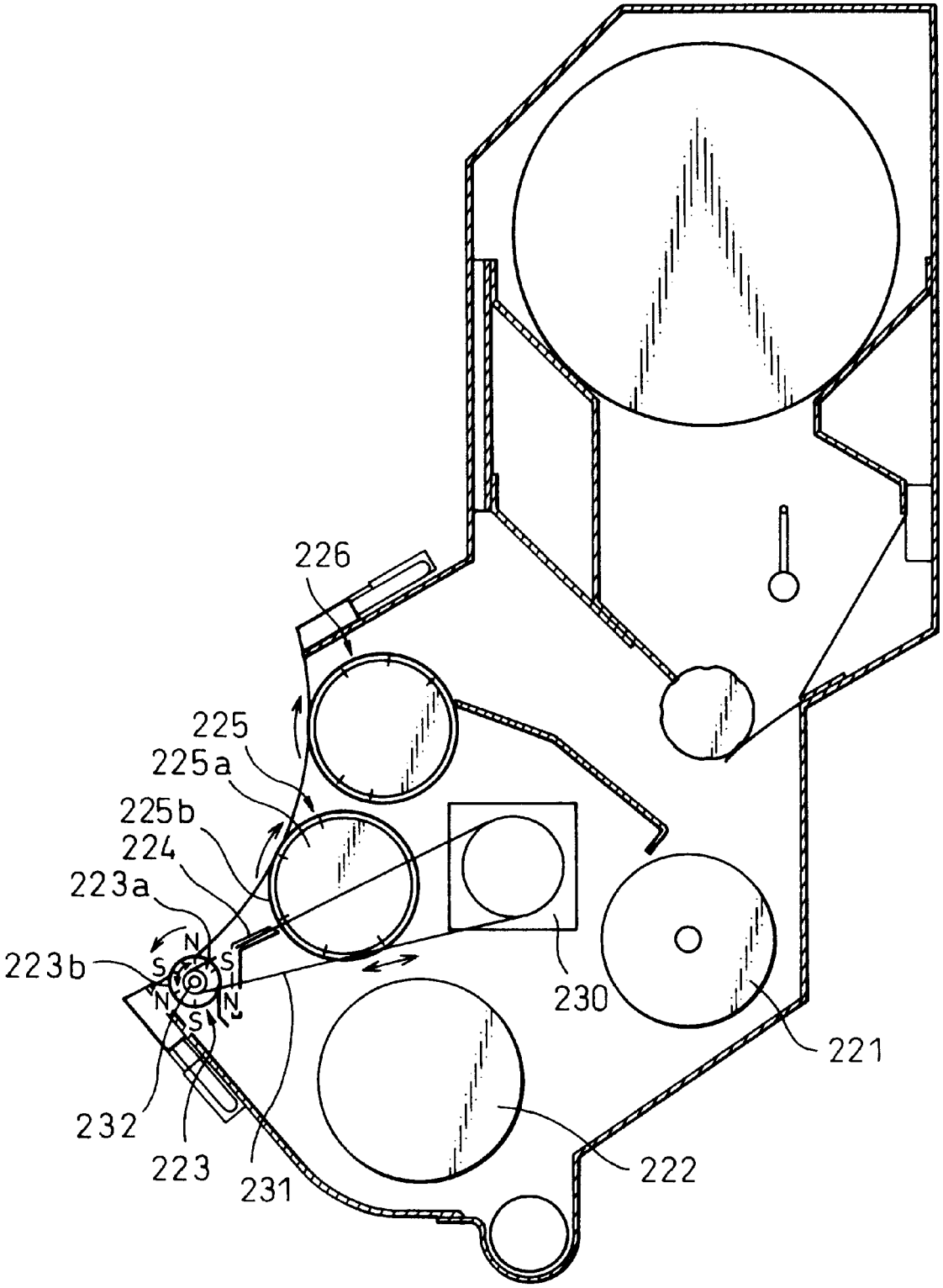
FIG. 25 shows a second embodiment of a developing apparatus.

FIGS. 23 to 25 show an embodiment of a processing unit of the electrophotographic apparatus, which comprises a photoconductor drum 201 as an electrostatic latent image carrying body. Around the photoconductor drum 201, there are an electric charger 212, an optical exposure unit 213, a developing unit, a pretransfer discharger 215, a transfer unit 216, a discharger 202, and a cleaner 219.

In the printing operation, the photoconductor drum 201 is rotated in the direction shown by an arrow, i.e., in the clockwise direction, so that the surface of the photoconductor drum 201 is uniformly charged by the electric charger 212. The surface of the photoconductor drum 201 is optically exposed according to a specific pattern by the optical exposure unit 213, so that an electrostatic latent image is formed on the photoconductor drum 201.

The electrostatic latent image on the photoconductor drum 201 is changed to a visible toner image by applying a developer from the developing unit 214.

The toner image thus developed is discharged by the pretransfer discharger 215 and then transferred to the recording sheet 217 which is beforehand charged at the reverse polarity from that of the toner. The toner image thus transferred to the recording sheet 217 is fed to a transfer unit 218 where the toner image is fixed onto the recording sheet 217 by applying thereto a heat, a pressure or an optical energy.

The residual toner remained on the photoconductor drum 201 after the transferring operation should be removed therefrom. Thus, the electric charge of the residual toner is removed by the discharger 220 and mechanically removed by the cleaner 219 from the photoconductor drum 201. The mechanical cleaner 219 comprises toner removing means, such as, a cleaning blade, cleaning brush, or the like. Thus, the photoconductor drum 201 is again uniformly charged by the electric charger 212 and thus prepared for the next printing operation.

The developer used in this developing unit 214 is a two-component developer comprising a toner component (fine particles of colored resin) and a magnetic component (fine particles of magnetic carrier). Such a two-component developer is well known and generally and widely used.

The developing unit 214 has a developer container 214*a* for containing developer. In the developer container 214*a*, there are a ribbon blender 221 for agitating the developer, a conveying roller 222 for conveying the developer to the first developing roller 225, a sleeve 225*b* of the first developing roller 225, a sleeve 226*b* of the second developing roller 226, and a sleeve 223*b* of the collecting roller 223, which are rotated by a motor, belts and pulleys, not seen, located the other side.

In this structure of the collecting roller 223, to rotate the magnet roller 223*a* it is necessary to drive the shaft of this side. In this embodiment, using the shaft of the ribbon blender 221, the magnet roller 223*b* of the collecting roller 223 is reversely rotated at the same speed as the sleeve 223*a* by the belt 229 and the pulley 228. The collecting roller 223 has six symmetrical poles. Therefore, the magnet roller 223*a* of the collecting roller 223 can be rotated synchronizingly with the developing unit 214.

The developer agitated by the ribbon blender 221 is conveyed to the first developing roller 225 by the conveyor roller 222 and electrostatically attached to the first developing roller 225. A doctor blade 224 is provided at a position upstream in the rotating direction from the developing area between the photoconductor drum 201 (FIG. 22) and the first developing roller 225, so that the height of the cut head of the magnetic brush can be regulated uniformly.

The doctor blade 224 has substantially the same axial width (or length) as the first developing roller 225 and comprises an inclined wall portion having a wedge tip opposite to the first developing roller 225 and a vertical wall portion extending downward from the other end of the inclined wall portion. The residual toner passed through the doctor blade 224 is collected from the inclined wall portion toward the vertical wall portion of this doctor blade 224 and supplied again to the agitating portion.

The collecting roller 223 is disposed in the developer collecting passage defined from the inclined wall portion toward the vertical wall portion of the doctor blade 224, in such a manner that the collecting roller 223 is in parallel to the first developing roller 225. In this embodiment, as mentioned above, the inner magnet roller 223*a* and the outer cylindrical sleeve 223*b* are both rotated at the same speed in the opposite directions to each other.

Therefore, even if the magnet roller 225*a* of the first developing roller 225 is located stationary, the magnetic field around the doctor blade 224 is always changed. Thus, the developer accumulated on the doctor blade 224 is moved toward the first developing roller 225 or the collecting roller 223 and removed from the doctor blade 224.

In this embodiment, in order to increase the developing efficiency two developing roller having the same size, i.e., the first and second developing rollers 225 and 226, are used. The residual developer remaining on the second developing roller 226 is also removed by any suitable means, such as a scraper, and returned to the agitating section.

FIG. 25 shows another embodiment of the developing apparatus. In FIG. 25, to rotate the magnet roller 223*a* of the collecting roller 223, it is necessary to drive the shaft of this side in the drawing. Therefore, in this embodiment, there is provided another step motor 223 which is driven at the initial time before the printing operation, or at the regular interval (in this embodiment, each 10,000 printing sheets).

Therefore, the magnet roller 223*a* of the collecting roller 230 is rotated at the initial time or at the regular interval to remove the developer accumulated on the doctor blade 224. Since the step motor 230 is used, the same effect can also by obtained by rotating the magnet roller 223*a* by an optional angle (60°, in this embodiment), and returning it to the initial position.

Figure 26:
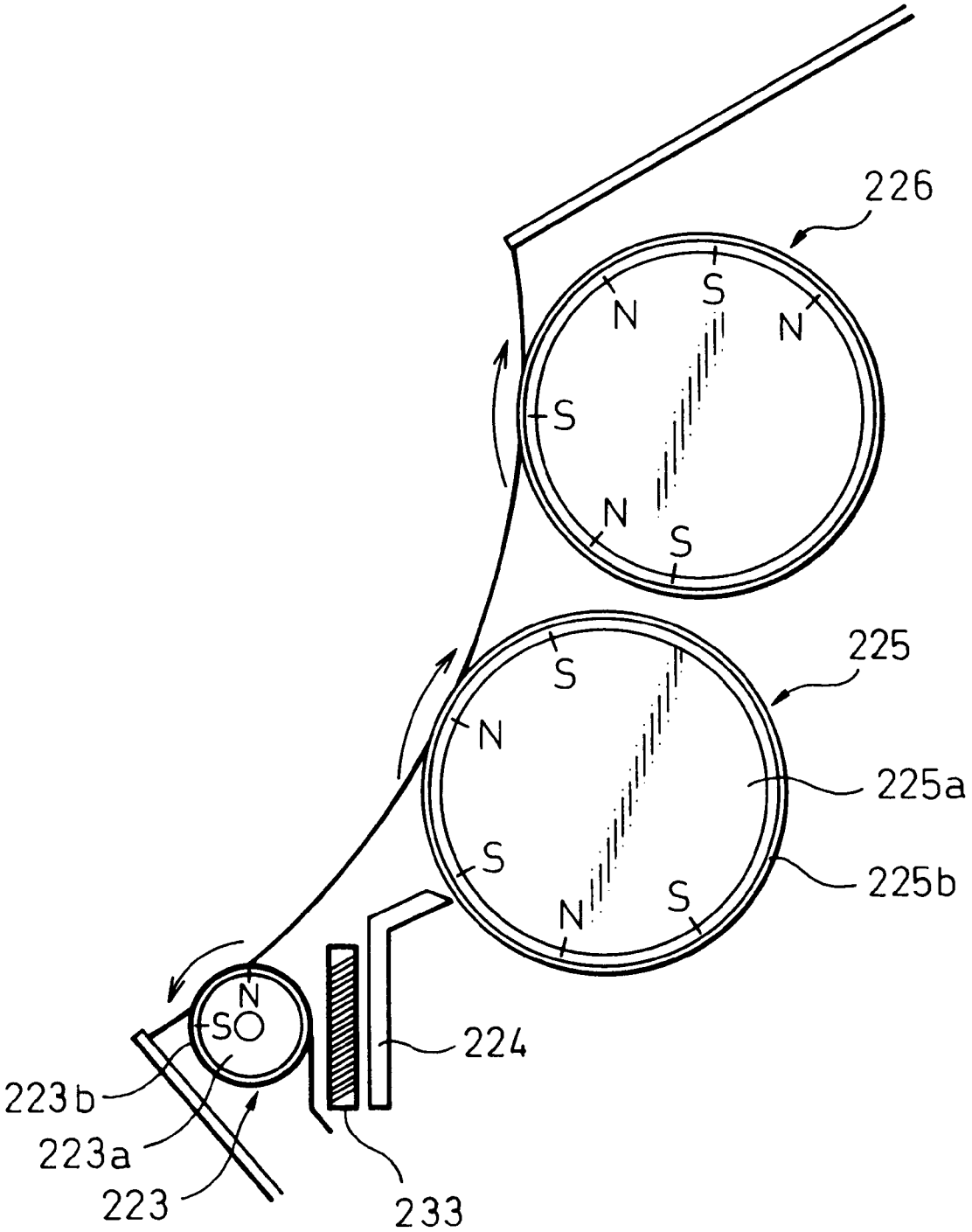
FIG. 26 shows a third embodiment of a developing apparatus.

FIG. 26 shows still another embodiment of the developing apparatus. In this embodiment, a solenoid 233 is provided between the doctor blade 224 and the collecting roller 223. At the initial time before the printing operation, or at the regular interval (in this embodiment, each 10,000 printing sheets), an electric voltage is applied to the solenoid 233. Therefore, the magnetic field around the doctor blade 224 can be changed at the initial time or at each predetermined number of recording sheets.

Figure 27:
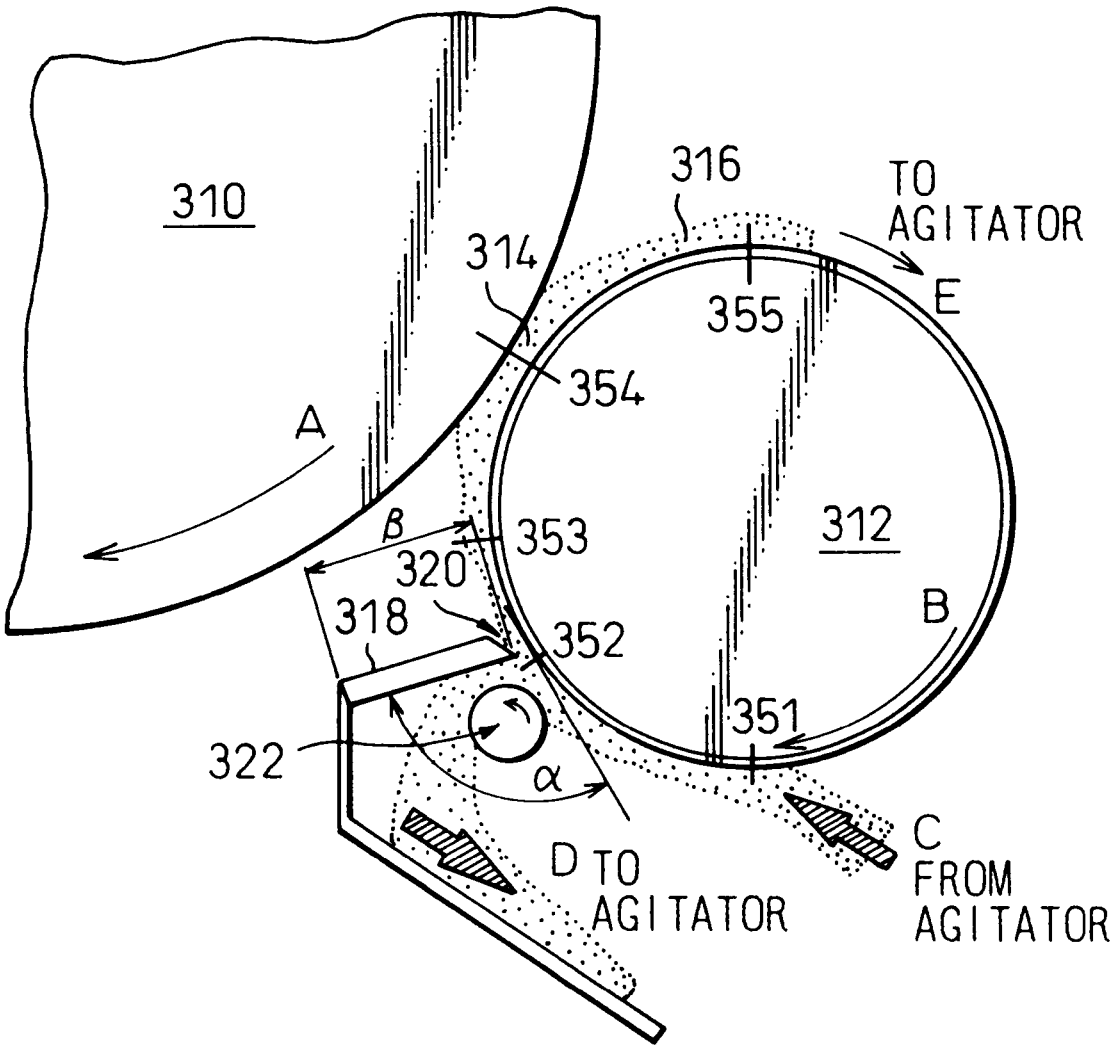
FIG. 27 is a partial cross-sectional view of a developing apparatus of an electronic photographic apparatus.

FIG. 27 shows a further embodiment of a developing apparatus. In this embodiment, a developer which is a mixture of a toner, the average diameter of the particles being 10 $\mu$m, and a carrier, the average diameter of the particles being 80 $\mu$m, one used.

As shown in FIG. 27, the developing apparatus of this embodiment comprises a photoconductor drum 310 as an electrostatic latent image carrying body which is rotated in the direction indicated by an arrow A, a developing magnet roller 312, a layer thickness regulating means (doctor blade) 318 for regulating the thickness of the layer of the developer 316, and a developer holding member (magnet roller 322 for holding the developer).

In this embodiment, the photoconductor drum 310 has a diameter of 200 mm and is rotated at a circumferential speed of 600 mm/sec in the clockwise direction indicated by an arrow A in FIG. 27. The developing magnet roller 312 has a diameter of 50 mm and is rotated at a sleeve circumferential speed of 600 mm/sec in the clockwise direction indicated by an arrow B. The gap between the photoconductor drum 310 and the developing magnet roller 312 is 2 mm.

The gap defines a developing area 314 in which the photoconductor drum 310 and the developing magnet roller 312 are rotated in the opposite direction to each other at the same circumferential speed. Consequently, in the developing area 314, a developer is attached to the electrostatic latent image formed beforehand on the photoconductor drum 310 during both the photoconductor drum 310 and the developing magnet roller 312 are rotated in the same speed in the opposite direction.

It is preferable that the doctor blade 318 is generally disposed at a position upstream of the developing area 314 and not so far away from the developing area 314 in consideration of the conveyance characteristic of the developer (usually, within 90° from the developing area 14 at the developing magnet roller 312). To stabilize the height of head of the developer at the developing area, the doctor blade should be disposed as near to the developing area as possible. However, in consideration of the flowability of the developer coming back to the developing area 314, the doctor blade is disposed at a position 65° upstream of the developing area 314 in this particular embodiment.

It is also preferable that the angle $\alpha$ of the doctor blade 318 is more than 90°, to prevent the developer from returning to the developing area. In this particular embodiment, the angle $\alpha$ is about 110°. In addition, in consideration of the flowability of the developer, it is preferable that the length $\beta$ of the doctor blade 316 is more than 10 mm. In this embodiment, the length $\beta$ is about 20 mm.

The developing magnet roller 312 comprises magnetic poles for conveying the developer 316 toward the developing area 314, i.e., a magnetic pole 351 (S-pole), a magnetic pole 352 (N-pole), and a magnetic pole 353 (S-pole), a pole for developing, i.e., a magnetic pole 354 (N-pole), and a pole for conveying the developer 316 from the developing area 314, i.e., a magnetic pole 355 (S-pole).

In the vicinity of the doctor blade 318, a developer conveying magnetic pole is generally provided for standing up the "ears or spikes" of the developer. A magnetic pole 352 is provided for this purpose.

The force of the conveying magnetic pole 352 located in the vicinity (slightly upstream) of the doctor blade 318 of the developing magnet roller 312 is 700 G, and the force of the developing magnetic pole 354 located nearest to the photoconductor 310 is 800 G. The forces of the other magnetic poles 351, 353 and 355 are generally 600–700 G. "H" in FIG. 28 indicates the developer 316 which is influenced and conveyed by the magnetic force of the pole 351.

As will be known, only the cylindrical sleeve of the developing magnet roller 312 is rotated in the direction shown by an arrow B, but the inner magnetic poles 351–355 are stationary.

In this invention, the magnet roller 322 for holding the developer is rotatably arranged in the vicinity, upstream side of the doctor blade 318, but opposite to the developing magnet roller 312. Therefore, the developer 316 conveyed by the agitating section (not shown) is attached to the developing magnet roller 312 and moved in the direction indicated by an arrow C. Thus, the amount of the developer 316 is regulated by the head cut portion 320 of the doctor blade 318 and, thus, the residual developer is held by the developer holding magnet roller 322 when it returns in the direction indicated by an arrow D to the agitating section.

Some embodiments of the developer holding means and the driving means thereof will now be described in detail.

EXAMPLE A

Figure 28:
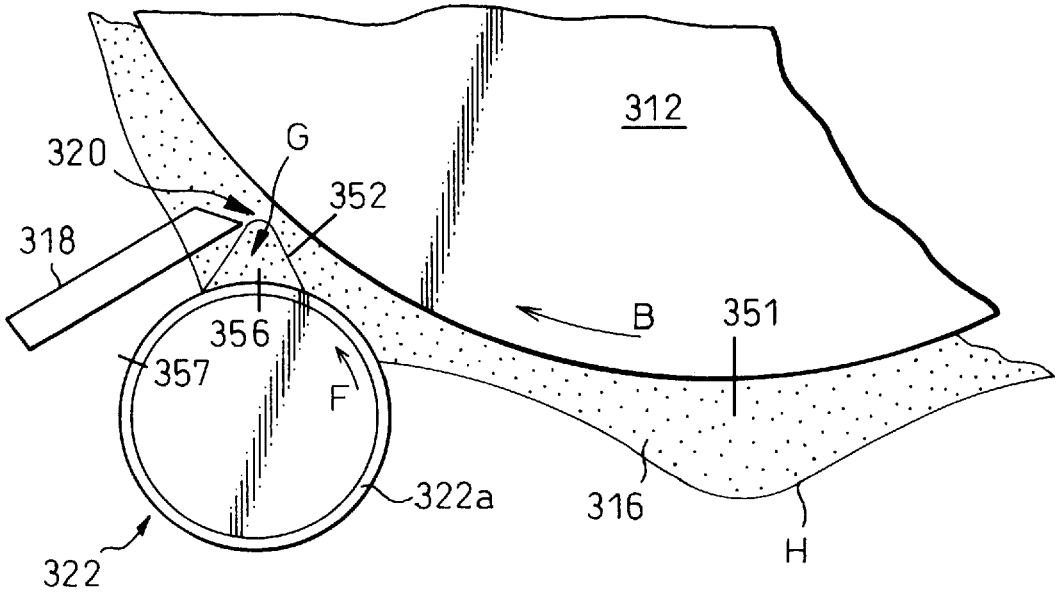
FIG. 28 is a partial enlarged view of FIG. 27, in which a developer holding magnet roller is rotated.
Figure 29:
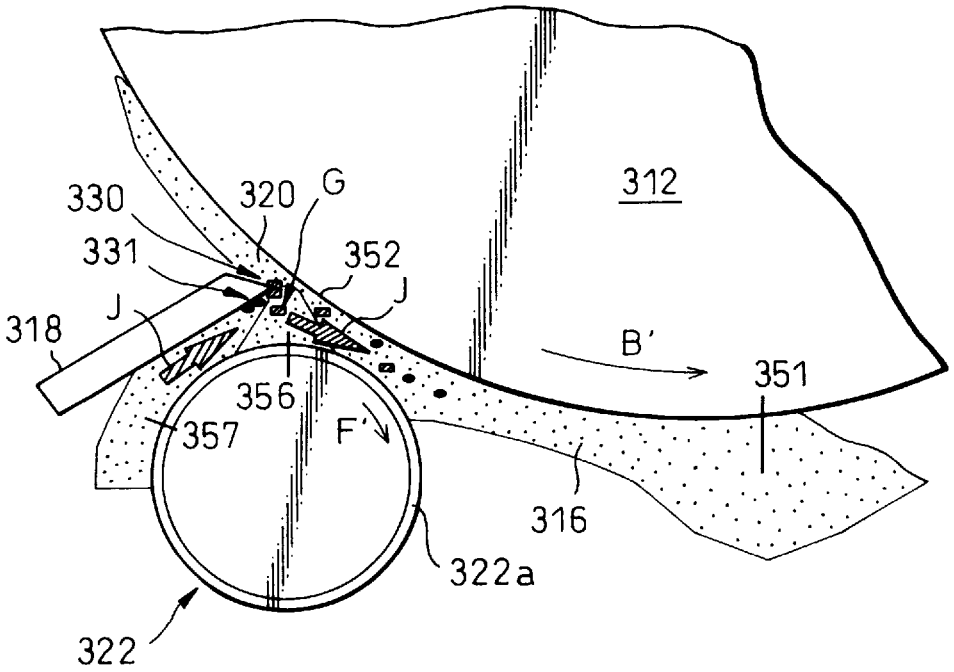
FIG. 29 is a view which corresponds to FIG. 27, but the developer holding magnet is rotated in the reverse direction at an initial time.

As shown in FIGS. 28 and 29, a developer holding magnet roller 322 is disposed at the upstream side of the doctor blade 318 and in parallel to the axial direction of the developing magnet roller 312. The axial length of the magnet roller 322 is substantially the same as that of the developing magnet roller 312. In this embodiment, the developing magnet roller 322 has a diameter of 16 mm and a sleeve circumferential speed of 100 mm/sec. The magnetic pole 356 located in the vicinity (slightly upstream) of the tip of the doctor blade 318 and opposite to the magnetic hole 352 of the developing magnet roller 312 has a magnetic force of 500 G at the S-pole and the magnetic pole 357 located at the base portion of the doctor blade 318 has a magnetic force of 400 G at the N-pole.

The magnetic pole 356 generates a magnetic force (indicated by "G") having a maximum flux in the vicinity of the head cut portion 320, which magnetic force is a pole (S) different from the pole (S) of the opposite developing magnet roller 312, i.e., the magnetic pole 352 in this embodiment.

In this embodiment, the developer holding magnet roller 312 is such a type that only the cylindrical, outer sleeve 233*a* is rotated, but the inner magnetic poles are stationary disposed. However, a developer holding magnet roller having no sleeve, but having inner rotatable magnetic poles 312, or any other type can also be used. In this case, the same effects can be obtainable.

As mentioned above, the developer holding magnet roller 322 is disposed at the upstream side near to the head cut portion 220 of the doctor blade 318, the developer 316 removed by the doctor blade 318 is held on the sleeve 322*a* of the developer holding magnet roller 322 by the magnetic force (the magnetic pole 356) of the developer holding magnet roller 322.

The operation when the sleeve 322*a* of the developer holding magnet roller 322 is stopped will be described below in detail.

The area on the sleeve 322*a* of the developer holding magnet roller 322 is under the influence of the magnetic pole 352 of the developing magnet roller 312. Therefore, even if the amount of conveyed developer 316 is small, the developer held on the sleeve 322*a* of the developer holding magnet roller 322 is attracted toward the developing magnet roller 312 by the magnetic force of the developing magnet roller 312 and therefore a sufficient amount of developer is supplied to the head cut portion 320 of the doctor blade 318.

Thus, it is no longer necessary to convey a large amount of developer 316 by the developing magnet roller 312 to supply a necessary amount of developer to the head cut portion 320.

The operation when the sleeve 322*a* of the developer holding magnet roller 322 is rotated in the direction F will now be described in detail.

In this embodiment, as mentioned above, the sleeve 322*a* is rotated at a circumferential speed of 100 mm/sec. The direction of rotation is usually the counter-clockwise direction F, as shown in FIG. 27 (opposite to the rotating direction B of the developing magnet roller).

The developer holding magnet roller 322 can also be rotated in the opposite direction F' as shown in FIG. 29, as will be described in detail later.

It is necessary to set the magnetic force of the developer holding magnet roller 322 so as not to affect the developer conveyance by the developer magnet roller 312. Thus, it is sufficient to set the magnetic force of the pole 356 of the developer holding magnet roller 322 opposite to the developer magnet roller 312 to be smaller than that of the pole 352 of the developer magnet roller 312. In this embodiment, the magnetic force of the pole 352 is 700 G and the magnetic force of the pole 356 is 500 G. Thus, in this embodiment, the developer conveyance by the developer magnet roller 312 is not affected at all.

The sleeve 322*a* of the developer holding magnet roller 322 is rotated, so that the developer on the developer holding magnet roller 322 can be conveyed to the head cutting portion 320 in the same manner as the developer magnet roller 312. Therefore, the amount of the developer on the developer holding magnet roller 322 can be controlled. In addition, by conveying the developer on the developer holding magnet roller 322, the amount of the developer which would directly touch the doctor blade 318 can be reduced and thus the stress exerted to the developer can also be diminished.

EXAMPLE B

The following control can be effected in addition to the control of the amount of the developer on the developer holding magnet roller 322.

In accordance with the working conditions of this developing apparatus, such as conditions of the developer or working environment, only the necessary amount of the developer 316 is supplied to the "ear or spike" cutting portion 320.

1). The condition in use of the developer is usually detected by counting the numbers of the printing sheets. In this embodiment, the sum of rotation number of the photoconductor drum 310 is counted and thus the use of the developer can detected. Of course, any other means for detecting the condition of the developer can also be used in this embodiment. In general, if the developer 316 becomes nearly to the life thereof, the fluidity thereof generally worsens.

That is to say, the amount of the developer 316 conveyed by the developer magnet roller 312 becomes smaller than initially in the same working conditions.

According to an experiment, the amount of the conveyed developer 316 nearly at the life thereof (such as, after printing of 1,000,000 sheets) was smaller by 15% than that at the initial condition. Thus, an unevenness of head height at the developing area 314 could be observed.

In the present invention provided with the developer holding magnet roller 322, after 500,000 to 100,000 sheets were printed, the circumferential speed of the sleeve 322*a* of the developer holding magnet roller 322 was set to be 110 mm/sec (increased by 10%). Thus, an unevenness of the head height at the developing area 314 could be not be observed.

2). The flowability of the developer depends on the activity (in particular, humidity) of the developer. If humidity is raised, flowability is reduced and vise versa. In the same manner as item 1), due to the flowability, an unevenness of the head height at the developing area 314 could be observed. In this embodiment, if the humidity is higher than a predetermined value, the speed of the developer holding magnet roller 322 is increased (in this embodiment, if the humidity is 65%, the speed is increased by 15%), and if the humidity is lower than the predetermined value, the speed of the developer holding magnet roller 322 is reduced (in this embodiment, if the humidity is lower than 20%, the speed is reduced by 10%). Thus, an unevenness of the head height at the developing area 314 could no longer observed.

EXAMPLE C

In the embodiment A, at the initial time during which no printing operation is effected, the developer holding magnet roller 322 is rotated in the clockwise direction F' as shown in FIG. 29.

When the developer holding magnet roller 322 is rotated, the developer 316 attached thereto is conveyed in the direction indicated by an arrow J to touch the surface of the doctor blade 318. Any foreign substance 330 (solid toner, fibrous particles or the like) attached to the doctor blade 318 is conveyed with the developer 316 including row toner 331 in the direction J and removed from the doctor blade 318.

In particular, the foreign substance 330 attached to the tips of the doctor blade 318 causes it to directly make uneven the amount of the developer 316 passing through the head cutting position 320, thereby reducing the printing quality.

Therefore, in accordance with kinds of substance which is to be removed, the speed of the developer holding magnet roller 322 is changed in such a manner that, if attached toner has to be removed, the circumferential speed is 150 mm/sec, and if fibrous particles are to be removed, the circumferential speed is 100 mm/sec.

In addition, the rotating direction of the developer holding magnet roller 322 is changed alternately at the initial time during which no printing operation is effected. Thus, the solid toner and the fibrous particles can effectively removed.

If the developer holding magnet roller 322 is rotated in the opposite direction B', i.e., in the counter clockwise direction, at the initial time, a more effective result could be obtained. In this manner, by removing the foreign substance 330 at the initial time, the printing quality can thus be stabilized.

It should be understood by those skilled in the art that the foregoing description relates to only some preferred embodiments of the disclosed invention, and that various changes and modifications may be made to the invention without departing from the spirit and scope thereof.

What we claim is:

1. A developing apparatus of an electrophotographic apparatus comprising:

a housing for accommodating a developer;

a plurality of developing rollers including a first, second and third developing roller rotatably disposed in said housing and arranged opposite to an electrostatic latent image carrying body for conveying a developer carried on respective surfaces of the developing rollers;

a conveyor roller rotatably disposed in said housing for conveying said developer carried on a surface thereof to one of said developing rollers;

a first screw conveyor disposed in said housing for conveying said developer in an axial direction thereof to supply it to said conveyor roller;

a second screw conveyor disposed in said housing for conveying said developer in an axial direction opposite to said axial direction of said first screw conveyor to supply it to said first screw conveyor;

each of said first and second conveyors having an axial length larger than an axial length of said developing rollers;

a partition wall disposed between said first and second screw conveyors;

a toner container for accommodating a toner, said container mounted on said housing;

a toner supply means for supplying the toner in said toner container into said housing;

an agitating means for agitating the toner supplied by said toner supply means and the developer in said housing;

a first doctor blade for regulating an amount of the developer carried on said conveyor roller; and a second doctor blade for regulating an amount of the developer carried on the first developing roller to which the developer is conveyed from said conveyor roller; and scraper means for scraping the developer carried on the second and third developing rollers.

2. A developing apparatus as set forth in claim 1 further comprising a plurality of agitators rotatably disposed in said toner container.

3. A developing apparatus as set forth in claim 1, wherein said toner container is mounted on said housing by means of electrically insulating means.

4. A developing apparatus as set forth in claim 3 further comprising a toner cartridge detachably mounted on said toner container for supplying the toner into said toner container.

* * * * *